US011150604B2

(12) United States Patent
Watanabe et al.

(10) Patent No.: US 11,150,604 B2
(45) Date of Patent: Oct. 19, 2021

(54) IMAGE FORMING APPARATUS WITH A TEMPERATURE CHANGE SUPPRESSOR

(71) Applicants: Kazuhiko Watanabe, Tokyo (JP); Hiroshi Nakai, Kanagawa (JP); Yasuhide Nakazawa, Kanagawa (JP)

(72) Inventors: Kazuhiko Watanabe, Tokyo (JP); Hiroshi Nakai, Kanagawa (JP); Yasuhide Nakazawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/941,557

(22) Filed: Jul. 29, 2020

(65) Prior Publication Data

US 2021/0034010 A1 Feb. 4, 2021

(30) Foreign Application Priority Data

Jul. 31, 2019 (JP) ..... JP2019-141377

(51) Int. Cl.
*G03G 21/20* (2006.01)
*G03G 21/12* (2006.01)

(52) U.S. Cl.
CPC ..... *G03G 21/20* (2013.01); *G03G 21/12* (2013.01)

(58) Field of Classification Search
CPC . G03G 21/12; G03G 21/20; G03G 2221/1815
USPC ..... 399/38, 44, 50, 53, 71, 91, 94–98
See application file for complete search history.

(56) References Cited

U.S. PATENT DOCUMENTS 7,885,554 B2 * 2/2011 Shirokoshi ..... G03G 21/1647 399/12

FOREIGN PATENT DOCUMENTS

| | | |
|---|---|---|
| JP | 3-088643 | 4/1991 |
| JP | 2001-142370 | 5/2001 |
| JP | 2006-154673 | 6/2006 |
| JP | 2007-219398 | 8/2007 |
| JP | 2068-116681 | 5/2008 |
| JP | 2009-237281 | 10/2009 |

* cited by examiner

*Primary Examiner* — Hoan H Tran
(74) *Attorney, Agent, or Firm* — Xsensus LLP

(57) ABSTRACT

An image forming apparatus includes an image bearer to bear a latent image, a charging device to charge the image bearer, a developing device to develop the latent image on the image bearer, a cleaning device to clean a surface of the image bearer, a target component including at least one of the image bearer, the charging device, the developing device, and the cleaning device, and a temperature change suppression member opposed adjacent to or disposed in contact with an outer peripheral face of the target component. The temperature change suppression member suppresses a temperature change of the target component.

18 Claims, 19 Drawing Sheets

IMAGE FORMING APPARATUS WITH A TEMPERATURE CHANGE SUPPRESSOR

CROSS-REFERENCE TO RELATED APPLICATION

This patent application is based on and claims priority pursuant to 35 U.S.C. § 119(a) to Japanese Patent Application No. 2019-141377, filed on Jul. 31, 2019, in the Japan Patent Office, the entire disclosure of which is hereby incorporated by reference herein.

BACKGROUND

Technical Field

Embodiments of the present disclosure generally relate to an image forming apparatus.

Description of the Related Art

A certain image forming apparatus includes an image bearer, a charging device to charge the image bearer, a developing device to develop a latent image on the image bearer, a cleaning device to clean the surface of the image bearer, and a temperature change suppression member to suppress temperature change of a target component subjected to temperature change suppression.

SUMMARY

Embodiments of the present disclosure describe an improved image forming apparatus that includes an image bearer to bear a latent image, a charging device to charge the image bearer, a developing device to develop the latent image on the image bearer, a cleaning device to clean a surface of the image bearer, a target component including at least one of the image bearer, the charging device, the developing device, and the cleaning device, and a temperature change suppression member opposed adjacent to or disposed in contact with an outer peripheral face of the target component. The temperature change suppression member suppresses a temperature change of the target component.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
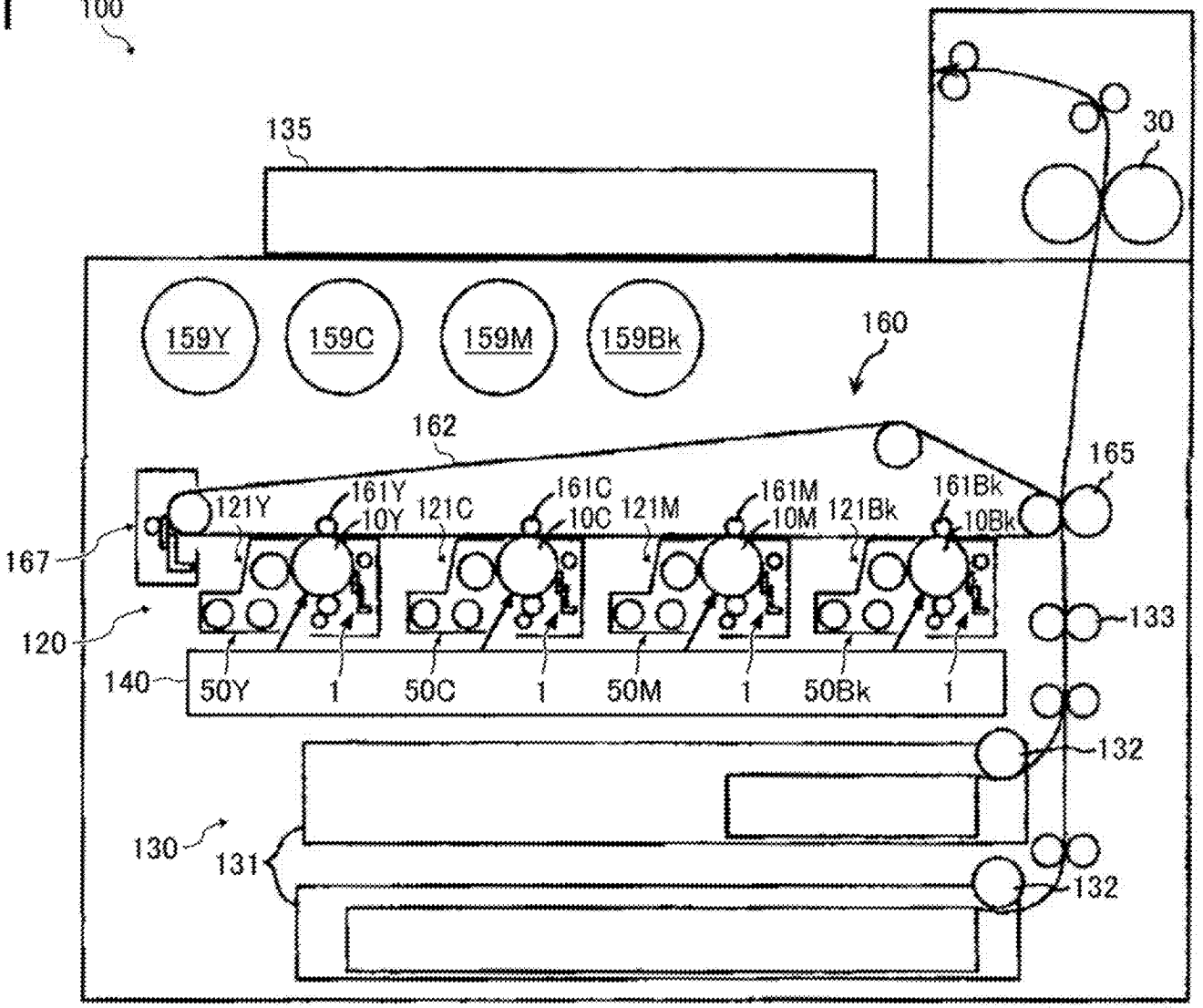
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and Bk attached to each reference numeral indicate only that components indicated thereby are used for forming yellow, magenta, cyan, and black images, respectively, and hereinafter may be omitted when color discrimination is not necessary or when four components for yellow, magenta, cyan, and black are referred together.

A description is given below of an electrophotographic image forming apparatus 100 according to an embodiment of the present disclosure. FIG. 1 is a schematic view of the image forming apparatus 100 according to the present embodiment when a temperature change suppression member described later is removed therefrom. The image forming apparatus 100 is capable of forming multicolor images and includes an image forming section 120, an intermediate transfer unit 160, and a sheet feeder 130.

The image forming section 120 includes process cartridges 121Y, 121C, 121M, and 121Bk as image forming units for yellow, cyan, magenta, and black toner, respectively. The process cartridges 121Y, 121C, 121M, and 121Bk are arranged in line in the substantially horizontal direction. Each of the process cartridges 121Y, 121C, 121M, and 121Bk is removably installable in the image forming apparatus 100 as a single unit.

The intermediate transfer unit 160 includes an intermediate transfer belt 162, primary transfer rollers 161Y, 161C, 161M, and 161Bk, and a secondary transfer roller 165. The intermediate transfer belt 162 is an endless belt entrained around multiple support rollers. The intermediate transfer belt 162 is disposed above the process cartridges 121Y, 121C, 121M, and 121Bk and along a direction in which drum-shaped photoconductors 10Y, 10C, 10M, and 10Bk (i.e., latent image bearers) of the process cartridges 121Y, 121C, 121M, and 121Bk rotate. The intermediate transfer belt 162 rotates in synchronization with the rotation of the photoconductors 10Y, 10C, 10M, and 10Bk. The primary transfer rollers 161Y, 161C, 161M, and 161Bk are disposed along an inner circumferential face of the intermediate transfer belt 162. With the primary transfer rollers 161Y, 161C, 161M, and 161Bk, the outer circumferential face of the intermediate transfer belt 162 is lightly pressed against the surfaces of the photoconductors 10Y, 10C, 10M, and 10Bk.

The process cartridges 121Y, 121C, 121M, and 121Bk are similar in the configuration and operation to form toner images on the photoconductors 10Y, 10C, 10M, and 10Bk by developing devices 50Y, 50C, 50M, and 50Bk, respectively, and to transfer the toner images onto the intermediate transfer belt 162. The three primary transfer rollers 161Y, 161C, and 161M corresponding to the process cartridges 121Y, 121C, and 121M for color are movable vertically with a swing mechanism. The swing mechanism disengages the intermediate transfer belt 162 from the photoconductors 10Y, 10C, and 10M when multicolor image formation is not performed. Additionally, a belt cleaning device 167 is disposed downstream from the secondary transfer roller 165 and upstream from the process cartridge 121Y in a direction of rotation of the intermediate transfer belt 162. The belt cleaning device 167 removes substances adhering to the intermediate transfer belt 162, such as residual toner after secondary transfer process.

Above the intermediate transfer unit 160, toner cartridges 159Y, 159C, 159M, and 159Bk corresponding to the respective process cartridges 121Y, 121C, 121M, and 121Bk are arranged substantially horizontally. Below the process cartridges 121Y, 121C, 121M, and 121Bk, an exposure device 140 is disposed. The exposure device 140 irradiates the charged surfaces of the photoconductors 10Y, 10C, 10M, and 10Bk with laser beams to form electrostatic latent images.

The sheet feeder 130 is disposed below the exposure device 140. The sheet feeder 130 includes sheet trays 131 that accommodate recording media (e.g., transfer sheets), and sheet feeding rollers 132. The sheet feeder 130 feeds transfer sheets to a secondary transfer nip between the intermediate transfer belt 162 and the secondary transfer roller 165 via a registration roller pair 133 at a predetermined timing.

A fixing device 30 is disposed downstream from the secondary transfer nip in a direction in which transfer sheets are conveyed (hereinafter, referred to as a "sheet conveyance direction"). Further, a sheet ejection roller pair and an output tray 135 on which the ejected transfer sheets are stacked are disposed downstream from the fixing device 30 in the sheet conveyance direction.

Figure 2:
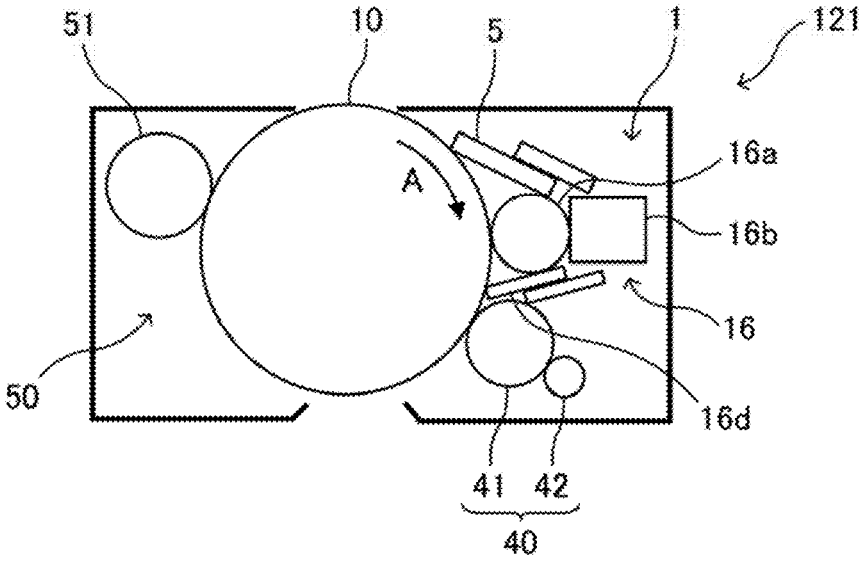
FIG. 2 is a schematic view illustrating a configuration of a process cartridge installable in the image forming apparatus illustrated in FIG. 1.

FIG. 2 is a schematic view illustrating a configuration of the process cartridge 121 installable in the image forming apparatus 100. The process cartridges 121Y, 121C, 121M, and 121Bk have a similar configuration, and therefore the suffixes Y, C, M, and Bk for color discrimination are omitted when the configuration and operation of the process cartridge 121 is described. The process cartridge 121 includes the drum-shaped photoconductor 10, and further includes a cleaning device 1, a lubricant supply device 16, a charging device 40, and the developing device 50 disposed around the photoconductor 10 in a casing thereof as a single unit.

The cleaning device 1 includes a strip-shaped elastic cleaning blade 5 elongated in the axial direction of the photoconductor 10. The lubricant supply device 16 includes a blade 16*d*, a solid lubricant 16*b*, and a lubricant supply roller 16*a* that slidingly contacts the photoconductor 10 and the solid lubricant 16*b*. The charging device 40 includes a charging roller 41 disposed opposite the photoconductor 10 and a roller cleaner 42 that rotates while contacting the charging roller 41. The developing device 50 is designed to deposit toner on the surface of the photoconductor 10 to develop the electrostatic latent image into a visible toner image and includes a developing roller 51 serving as a developer bearer that bears a developer including carrier and toner.

The four process cartridges 121 described above are removably installable in the image forming apparatus 100 by a technician or a user, individually. In the process cartridge 121 removed from the image forming apparatus 100, the photoconductor 10, the charging device 40, the developing device 50, the cleaning device 1, and the lubricant supply device 16 can be individually replaced with new ones.

A description is given below of the operation of the image forming apparatus 100.

The image forming apparatus 100 receives print commands from a control panel thereof or an external device such as a personal computer. Initially, the photoconductor 10 starts rotating in the direction indicated by arrow A in FIG. 2, and the charging roller 41 of the charging device 40 charges the surface of the photoconductor 10 uniformly in a predetermined polarity. With reference again to FIG. 1, the exposure device 140 irradiates the charged photoconductors 10 with laser beams corresponding to respective color data. The laser beams are optically modulated according to multicolor image data input to the image forming apparatus 100. Thus, electrostatic latent images for respective colors are formed on the photoconductors 10. The developing rollers 51 of the developing devices 50 supply respective developers to the electrostatic latent images, thereby developing the electrostatic latent images into toner images (visible images).

Subsequently, a primary-transfer voltage opposite in polarity to the toner image is applied to the primary transfer rollers 161, thereby generating primary-transfer electric fields between the photoconductors 10 and the primary transfer rollers 161 via the intermediate transfer belt 162. Simultaneously, the primary transfer rollers 161 lightly press the intermediate transfer belt 162 against the photoconductors 10 to form the primary transfer nips. Thus, the toner images on the respective photoconductors 10 are primarily transferred onto the intermediate transfer belt 162 efficiently. More specifically, the toner images are transferred from the photoconductors 10 and deposited one on another, thereby forming a multilayer toner image on the intermediate transfer belt 162.

A transfer sheet is conveyed from the sheet tray 131 via the sheet feeding roller 132 and the registration roller pair 133 toward the multilayer toner image on the intermediate transfer belt 162 at a predetermined timing. A secondary-transfer voltage opposite in polarity to the toner image is applied to the secondary transfer roller 165, thereby forming a secondary-transfer electric field between the intermediate transfer belt 162 and the secondary transfer roller 165 via the transfer sheet. Accordingly, the multilayer toner image is transferred onto the transfer sheet by the secondary-transfer electric field. The transfer sheet carrying the multilayer toner image is conveyed to the fixing device 30, and the multilayer toner image is fixed on the transfer sheet under heat and pressure. The transfer sheet carrying the fixed toner image is ejected by the sheet ejection roller pair and stacked on the output tray 135. After the primary transfer, residual toner remaining on the respective photoconductors 10 is removed by the cleaning blades 5 of the cleaning devices 1.

The image forming apparatus 100 is often used in an air-conditioned office environment. Since the temperature in an office is usually controlled to about 25° C. during work, the image forming apparatus 100 is used in an atmosphere of about 25° C. After air conditioning is turned off after work, the temperature of the image forming apparatus 100 changes according to the temperature change in the office. For example, in winter, after the air conditioning is turned off at the end of work at 18:00 on Monday, the temperature in the office drops until the air conditioning is turned on at the start of work on the next Tuesday morning. When the office is located in a cold district, the image forming apparatus 100 may be cooled to a low temperature of less than 10° C. at the start of work at 8:00 on the next morning 14 hours later.

The cleaning blade 5, the charging roller 41 used for forming toner images are mainly made of a material such as a urethane rubber or a resin material, the characteristics of which are likely to change with temperature. Therefore, due to the change in an ambient temperature, the rubber hardness and elasticity of the cleaning blade 5 are likely to change, and the rubber hardness and electric resistance of the charging roller 41 are likely to change. Accordingly, the cleaning performance or the charging performance may be greatly change, resulting in an abnormal image. In particular, when the office environment is cooled to a temperature lower than 10° C., the abnormal image may occur due to poor cleaning or poor charging.

For example, a material having a small characteristic change with respect to temperature of the rubber or the resin material forming the cleaning blade 5 or the charging roller 41 can prevent the above-described abnormal image to some extent, but there is a limit.

When in the developing device 50 used for forming toner images is cooled to a low temperature, toner may be excessively charged and agglomerated. Further, when the photoconductor 10 used for forming toner images is cooled to a low temperature, the characteristic of the photosensitive layer thereof changes, such as a decrease in sensitivity. As a result, the potential of the photoconductor 10 exposed by the exposure device 140 may be not lowered to a desired potential, causing image density to vary.

To solve the above-described problems, there are a method of raising the temperature by a heater provided in the image forming apparatus and a method of controlling the temperature in the image forming apparatus by an air conditioner. However, these methods cause the image forming apparatus to become large and the power consumption to increase.

Figure 3:
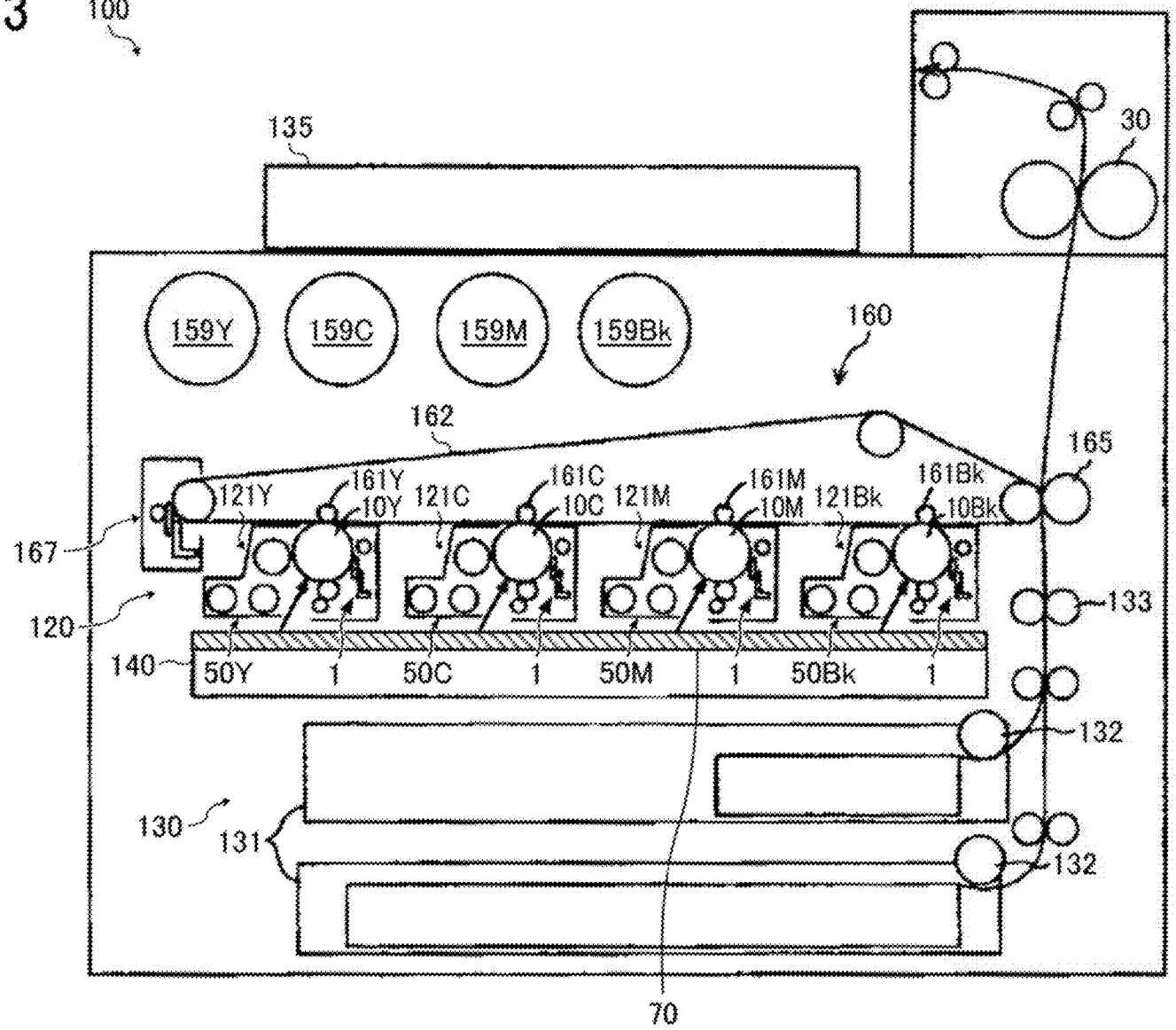
FIG. 3 is a schematic view illustrating a configuration of the image forming apparatus illustrated in FIG. 1, in which a latent heat storage member is disposed below the process cartridge in the vertical direction.

Therefore, in the present embodiment, as illustrated in FIG. 3, a latent heat storage member 70 as the temperature change suppression member is disposed below the process cartridges 121Y, 121C, 121M, 121Bk, which are the image forming units, in the vertical direction. Target components subjected to temperature change suppression includes the developing device 50, the charging roller 41, the photoconductor 10, and the cleaning blade 5 (hereinafter, referred to as "key parts"). With this configuration, the temperature of the key parts is prevented from dropping.

Figure 4:
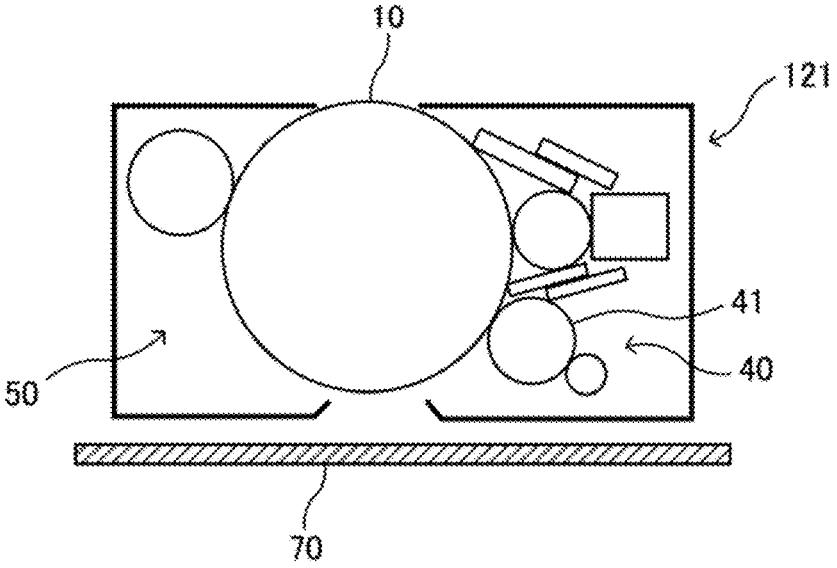
FIG. 4 is a schematic view of the process cartridge and the latent heat storage member illustrated in FIG. 3.
Figure 5:
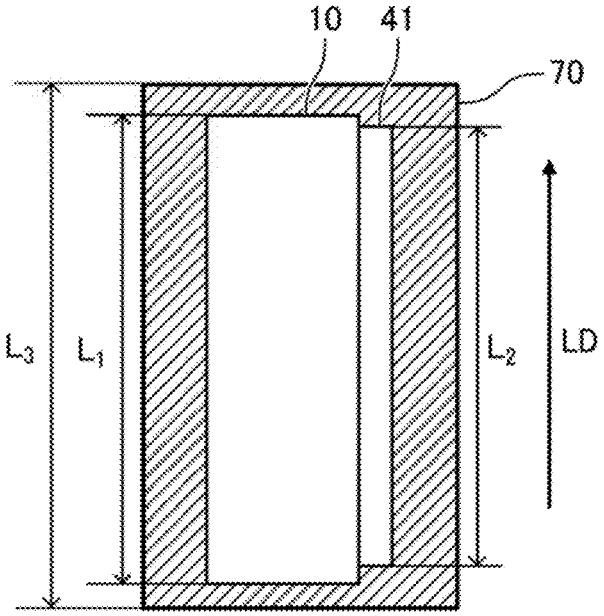
FIG. 5 is a schematic view of a photoconductor and a charging roller of the process cartridge and the latent heat storage member illustrated in FIG. 3.

FIG. 4 is a schematic view of the process cartridge 121 and the latent heat storage member 70, and FIG. 5 is a schematic view of the photoconductor 10, the charging roller 41, and the latent heat storage member 70. As illustrated in FIG. 4, the latent heat storage member 70 is disposed immediately below the process cartridge 121 and is opposed adjacent to the outer peripheral faces of the developing device 50 and the photoconductor 10. Further, the latent heat storage member 70 is opposed adjacent to the outer peripheral face of the charging roller 41 via the casing of the process cartridge 121. A length L3 of the latent heat storage member 70 is longer than a length L1 of the photoconductor 10 and a length L2 of the charging roller 41, which are the key parts, in a longitudinal (axial) direction LD of the photoconductor 10. The latent heat storage member 70 is provided with a through hole that allows the laser beam of the exposure device 140 to pass therethrough.

A pack made of, for example, aluminum is filled with the latent heat storage member 70. The pack is disposed below the process cartridges 121Y, 121C, 121M, and 121Bk in the vertical direction. The latent heat storage member 70 absorbs heat during the phase change from solid to liquid and releases heat during the phase change from liquid to solid, which are called latent heat. The latent heat storage member 70 utilizes the latent heat to suppress the temperature change. The latent heat storage member 70 includes, for example, sodium acetate hydrate, sodium sulfate hydrate, sodium thiosulfate hydrate, calcium chloride hydrate, and paraffin.

In the present embodiment, preferably, the latent heat storage member 70 has a melting point ranging from 20° C. to 30° C. More preferably, the melting point is lower than a reference temperature in the office (e.g., 25° C.). That is, the reference temperature is a temperature of the air-conditioned office environment where the image forming apparatus 100 is used. By setting the melting point of the latent heat storage member 70 to the above-described temperature, the latent heat storage member 70 melts and absorbs heat as the latent heat when the temperature is 30° C. or higher inside the image forming apparatus 100 used in the office environment. After the air conditioning is turned off after work and the temperature inside the image forming apparatus 100 drops, the latent heat storage member 70 solidifies. At that time, the latent heat storage member 70 release the heat as the latent heat, thereby preventing the temperature of the key parts disposed adjacent to the latent heat storage member 70 from dropping. By setting the melting point to be lower than the reference temperature in the office (e.g., 25° C.), the latent heat storage member 70 remains in the liquid phase during work, and the latent heat storage member 70 solidifies and releases the heat as the latent heat when the temperature in the image forming apparatus 100 drops below the reference temperature in the office (e.g., 25° C.) after work.

In the present embodiment, as illustrated in FIG. 4, the latent heat storage member 70 is opposed adjacent to the outer peripheral face of the key parts, such as the developing device 50 and the photoconductor 10. With this configuration, as the temperature in the image forming apparatus 100 drops, the heat released when the latent heat storage member 70 solidifies is efficiently transferred to the key parts, thereby suppressing the temperature drop of the key parts. Further, the latent heat storage member 70 opposed adjacent to the key parts insulates heat radiated from the key parts. As a result, the temperature around the key parts can be prevented from dropping, thereby suppressing the heat dissipation of the key parts.

An exterior cover covers the interior of the image forming apparatus 100, and a component such as the fixing device 30 that becomes hot is disposed inside the image forming apparatus 100. Therefore, the temperature inside the image forming apparatus 100 is generally higher than the outside temperature outside the image forming apparatus 100. In the image forming apparatus 100, warm air moves to the upper portion of the image forming apparatus 100 due to updraft and is discharged from the upper portion. Cool air outside the image forming apparatus 100 flows into the image forming apparatus 100 through the lower portion of the image forming apparatus 100. Then, the cool air that has flowed into the image forming apparatus 100 through the lower portion rises and cool the key parts such as the photoconductor 10.

However, in the present embodiment, as illustrated in FIGS. 3 and 4, the latent heat storage member 70 is disposed directly below the process cartridge 121, so that the cool air that has flowed into the image forming apparatus 100 is prevented from flowing into the process cartridge 121 from the lower side of the process cartridge 121. Accordingly, the cool air does not touch the key parts such as the photoconductor 10 and the charging roller 41, and the heat of the key parts is prevented from being taken away. Thus, the temperature drop of the key parts such as the photoconductor 10 and the charging roller 41 can be suppressed.

Further, the heat released from the latent heat storage member 70 warms the air around the latent heat storage member 70, and the warmed air rises and flows to the key parts such as the photoconductor 10 disposed above the latent heat storage member 70. Thus, the temperature around the key parts such as the photoconductor 10 and the charging roller 41 is prevented from dropping, thereby suppressing the temperature drop of the key parts.

Further, in the present embodiment, as illustrated in FIG. 5, the length L3 of the latent heat storage member 70 is longer than the lengths L1 and L2 of the key parts such as the photoconductor 10 and the charging roller 41 in the longitudinal direction LD. Thus, the latent heat storage member 70 is disposed extending over the entire areas of the key parts in the longitudinal direction LD. As a result, the above-described effect can be obtained, and the temperature drop can be suppressed in the entire areas of the key parts in the longitudinal direction LD.

Figure 6:
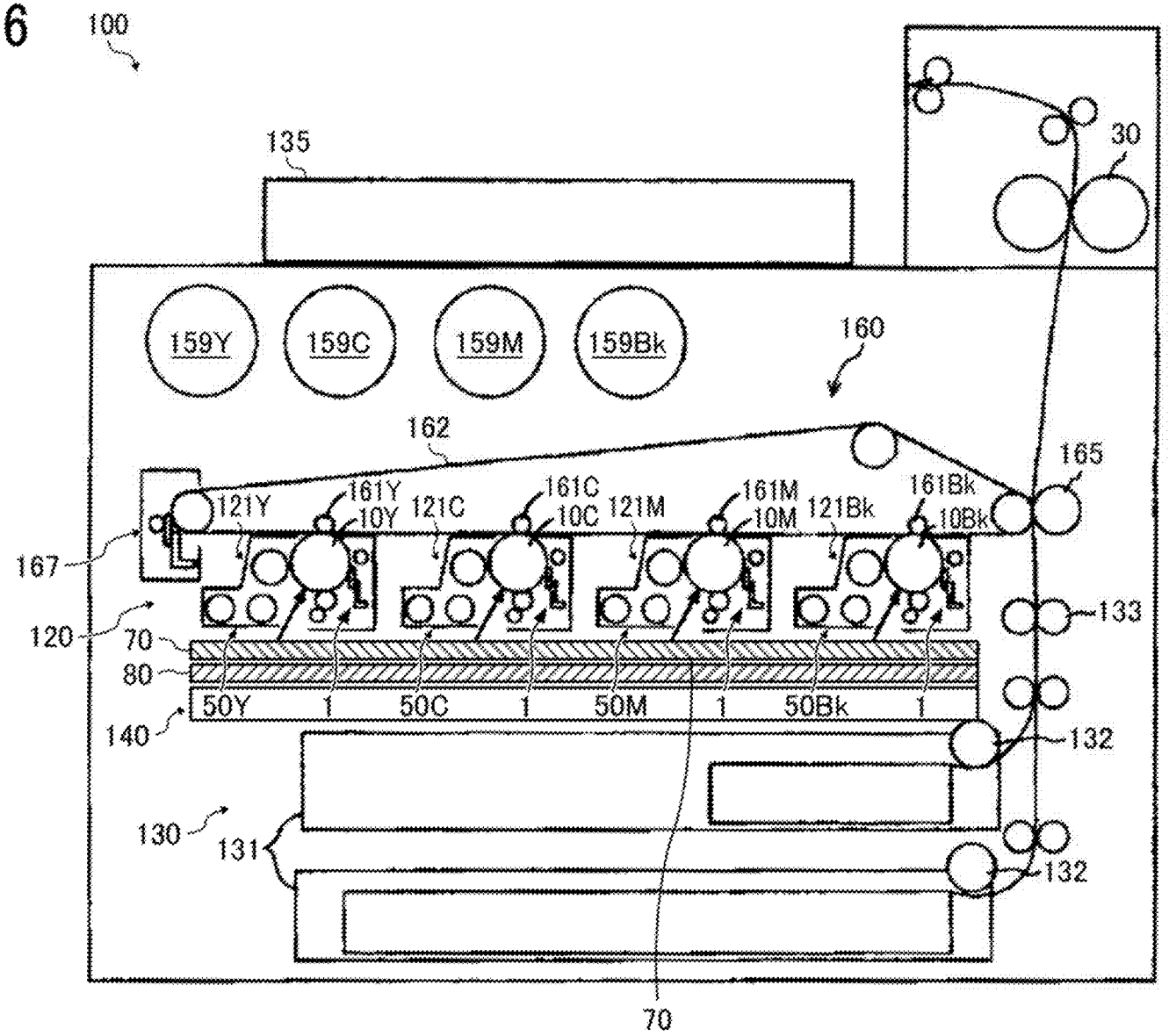
FIG. 6 is a schematic view illustrating a configuration of the image forming apparatus in which a heat insulating member is disposed below the latent heat storage member according to an embodiment of the present disclosure.
Figure 7:
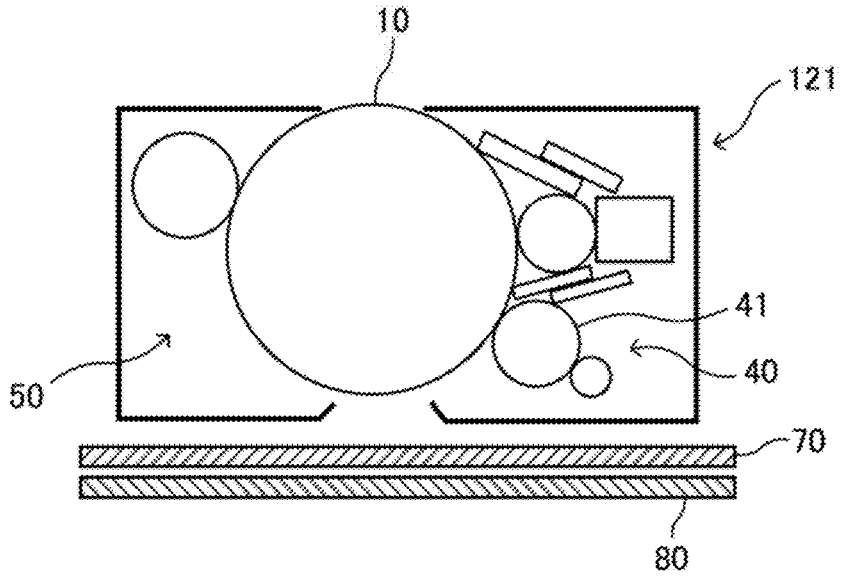
FIG. 7 is a schematic view of the process cartridge, the latent heat storage member, and the heat insulating member illustrated in FIG. 6.

FIG. 6 is a schematic view illustrating the configuration of the image forming apparatus 100 in which a heat insulating member 80 is disposed below the latent heat storage member 70. FIG. 7 is a schematic view of the process cartridge 121, the latent heat storage member 70, and the heat insulating member 80.

The heat insulating member 80 as the temperature change suppression member includes a fiber heat insulating member such as glass wool or a foamed heat insulating member such as urethane foam. The heat insulating member 80 has a size equal to or larger than that of the latent heat storage member 70 and is opposed adjacent to the entire area of the latent heat storage member 70. The latent heat storage member 70 and the heat insulating member 80 are provided with a through hole that allows the laser beam of the exposure device 140 to pass therethrough. In the present embodiment, the heat insulating member 80 is opposed adjacent to the latent heat storage member 70. Alternatively, the heat insulating member 80 may be disposed in contact with the latent heat storage member 70.

The heat insulating member 80 disposed below the latent heat storage member 70 can inhibit the heat transfer between the latent heat storage member 70 and the air that has flowed into the image forming apparatus 100 from the lower portion of the image forming apparatus 100, and the heat released from the latent heat storage member 70 can efficiently warm the key parts disposed above the latent heat storage member 70, thereby suppressing the temperature drop of the key parts.

In another embodiment, the heat insulating member 80 alone may be disposed below the process cartridge 121. Even with such a configuration, the heat insulating member 80 can inhibit the heat transfer between the air around the key parts warmed by the heat radiated from the key parts such as the photoconductor 10 and the cool air that has flowed into the image forming apparatus 100 from below, thereby suppressing the temperature drop around the key parts. Thus, the key parts is prevented from dissipating the heat, and the temperature drop of the key parts can be suppressed.

Figure 8:
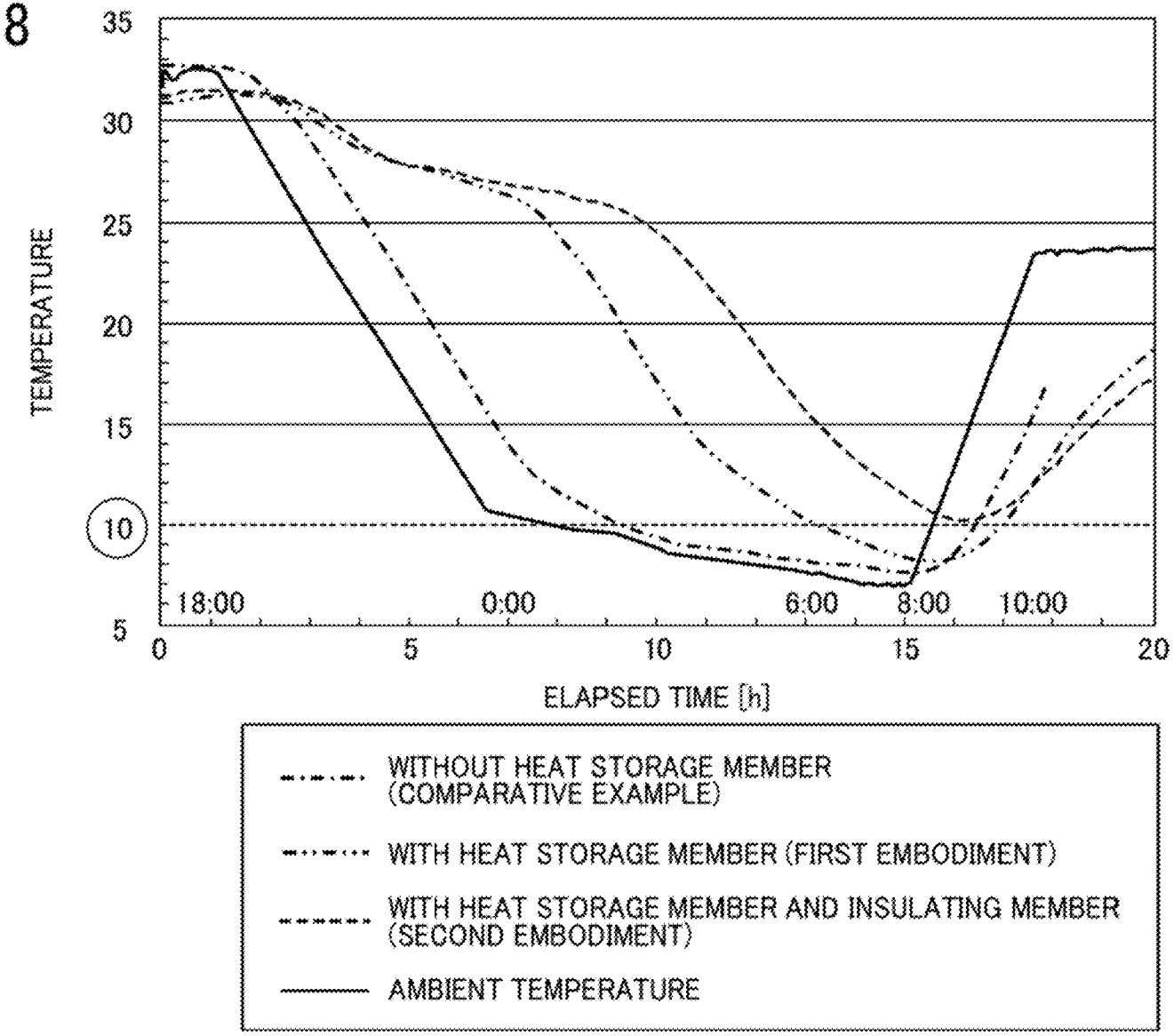
FIG. 8 is a graph illustrating a temperature change of the charging roller when the temperature of a thermostatic chamber in which the image forming apparatus is disposed rapidly drops from 32° C. to 10° C. and then progressively drops to 7° C.

FIG. 8 is a graph illustrating a temperature change of the charging roller 41 when the temperature of a thermostatic chamber in which the image forming apparatus 100 is disposed (i.e., an ambient temperature around the image forming apparatus 100) is rapidly lowered from 32° C. to 10° C. and then progressively lowered to 7° C.

The solid line in the graph in FIG. 8 represents the change of the ambient temperature, and the dashed dotted line in the graph in FIG. 8 represents the change of the temperature of the charging roller 41 in the image forming apparatus 100 without the latent heat storage member 70 and the heat insulating member 80 (i.e., a comparative example). The dashed double-dotted line in the graph in FIG. 8 represents the temperature change of the charging roller 41 in the image forming apparatus 100 (see FIG. 3) in which only the latent heat storage member 70 is disposed below the process cartridges 121 (i.e., a first embodiment). The dashed line in the graph in FIG. 8 represents the temperature change of the charging roller 41 in the image forming apparatus 100 (see FIG. 6) in which the latent heat storage member 70 and the heat insulating member 80 are arranged below the process cartridges 121 (i.e., a second embodiment).

The latent heat storage member 70 having a melting point of about 25° C. was used. The temperature of the charging roller 41 of the process cartridge 121Y for yellow was measured, which is the closest to the exterior cover of the image forming apparatus 100 and is most susceptible to the change of the ambient temperature.

As illustrated in FIG. 8, in the comparative configuration in which the latent heat storage member 70 and the heat insulating member 80 are not provided, the temperature of the charging roller 41 drops to 10° C. in about 1.5 hours after the ambient temperature outside the image forming apparatus 100 drops to 10° C. or less. After that, the temperature of the charging roller 41 is almost the same as the ambient temperature outside the image forming apparatus 100.

On the other hand, in the first embodiment, in which the latent heat storage member 70 is provided, the temperature of the charging roller 41 can remain at a temperature higher than the ambient temperature outside the image forming apparatus 100 until after 15 hours when the ambient temperature outside the image forming apparatus 100 starts rising. After the ambient temperature drops to 10° C. or less, it takes about 5.5 hours until the temperature of the charging roller 41 reaches 10° C., and the time until the temperature of the charging roller 41 drops to 10° C. or less is significantly extended as compared with the comparative example.

It can be seen from FIG. 8, with the latent heat storage member 70 having the melting point of 25° C., the latent heat storage member 70 releases heat until the latent heat storage member 70 completes the phase transition from the liquid phase to the solid phase. As a result, the temperature around the latent heat storage member 70 remains at about 25° C. Thus, while the ambient temperature drops toward 10° C., the latent heat storage member 70 serves as a heat source and applies the heat so that the charging roller 41 remains around 25° C. Therefore, the temperature of the charging roller 41 does not drop with the ambient temperature outside the image forming apparatus 100.

In the second embodiment, in which the latent heat storage member 70 and the heat insulating member 80 are provided, the temperature of the charging roller 41 can remain at 10° C. or more even after 15 hours when the ambient temperature outside the image forming apparatus 100 starts rising. The temperature of the charging roller 41 did not drop to 10° C. for more than 8 hours after the ambient temperature outside the image forming apparatus 100 drops to 10° C. or less. The heat insulating member 80 can prevent the cool air that has flowed into the image forming apparatus 100 from cooling the latent heat storage member 70. It can be seen from FIG. 8, the charging roller 41 remains around 25° C. in a period longer than that in the first embodiment. As a result, the temperature drop of the charging roller 41 can be further prevented as compared with the first embodiment.

As described above, the latent heat storage member 70 is opposed adjacent to the key parts that are required to suppress the temperature drop thereof. Therefore, the temperature of the key parts can be prevented from dropping and maintained at the temperature that does not affect images for a long time. Further, the heat insulating member 80 is provided. Therefore, the temperature drop of the key parts can be further suppressed, and the temperature of the key parts can be maintained at the temperature that does not affect images for a longer time.

Figure 9:
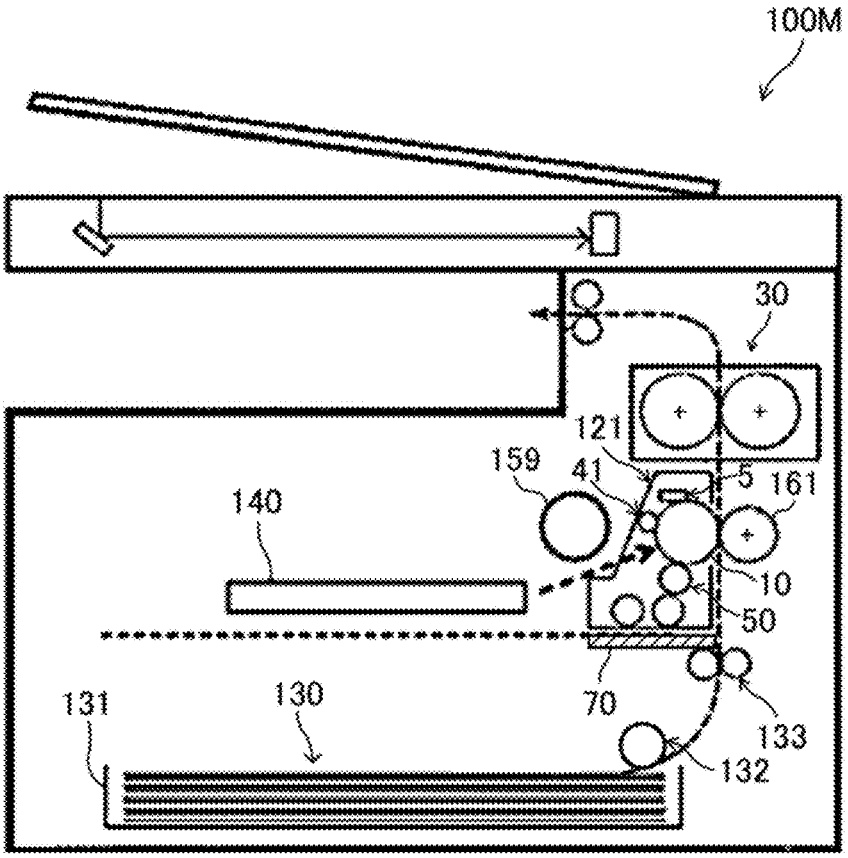
FIG. 9 is a schematic view of a monochrome image forming apparatus provided with a latent heat storage member according to an embodiment of the present disclosure.
Figure 10:
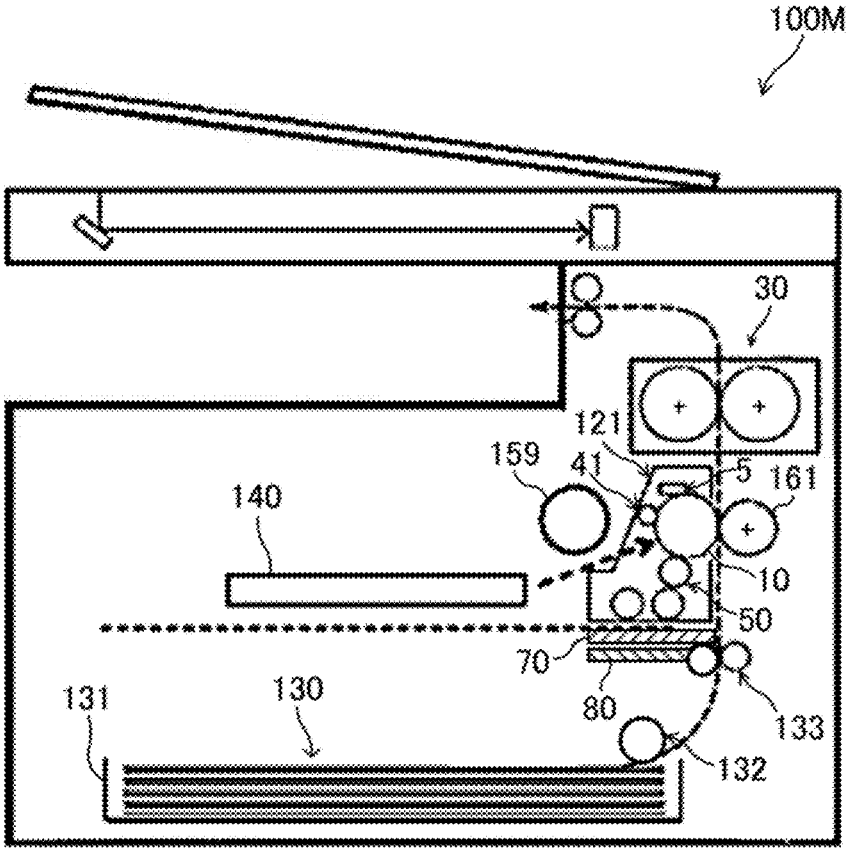
FIG. 10 is a schematic view of the monochrome image forming apparatus provided with the latent heat storage member and a heat insulating member according to an embodiment of the present disclosure.

In the above embodiments, the image forming apparatus 100 that includes the four process cartridges 121 to form multicolor images is described. Alternatively, the present disclosure is also applicable to a monochrome image forming apparatus that includes only one process cartridge for black to form monochrome images. Specifically, as illustrated in FIG. 9, the latent heat storage member 70 is disposed below the process cartridge 121 of the monochrome image forming apparatus 100M, or as illustrated in FIG. 10, the latent heat storage member 70 is disposed below the process cartridge 121, and the heat insulating member 80 is disposed below the latent heat storage member 70. Similarly to the above-described embodiments, the latent heat storage member 70 is opposed adjacent to at least one of the photoconductor 10, the developing device 50, the charging roller 41, and the cleaning blade 5 included in the process cartridge 121. With this configuration, the temperature drop of the at least one of the photoconductor 10, the developing device 50, the charging roller 41, and the cleaning blade 5 can be suppressed. Further, the heat insulating member 80 is disposed closely below the latent heat storage member 70 as illustrated in FIG. 10. With this configuration, the heat insulating member 80 sustains the effect of the latent heat storage member 70 for maintaining temperature, thereby suppressing the temperature drop of the at least one of the photoconductor 10, the developing device 50, the charging roller 41, and the cleaning blade 5 for a long time.

Next, experiments are described in which the arrangement of the latent heat storage member 70 and the heat insulating member 80 is changed. A plurality of sheet-like packs, which is made of aluminum or the like, filled with the latent heat storage member 70 was prepared. The total weight of the latent heat storage member 70 was fixed. The latent heat storage member 70 was arranged around the four process cartridges 121Y, 121C, 121M, and 121Bk in different positions. The similar experiment as illustrated in FIG. 8 was performed for each of the different positions. That is, the temperature change of the charging roller 41 of the process cartridge 121Y for yellow was measured when the temperature of the thermostatic chamber in which the image forming apparatus 100 was disposed (i.e., the ambient temperature around the image forming apparatus 100) was rapidly lowered from 32° C. to 10° C. and then progressively lowered to 7° C. The latent heat storage member 70 having a melting point of about 25° C. was used.

Table 1 summarizes the arrangement conditions of the latent heat storage member 70 and the heat insulating member 80 around the process cartridge 121.

TABLE 1

| Condition No. | Arrangement of Heat Storage Member | Arrangement of Insulator |
|---|---|---|
| 1 | none | none |
| 2 | On 6 sides of Process Cartridges | none |
| 3 | On 6 sides of Process Cartridges | On 6 sides of Heat Storage Member |
| 4 | Above and Below Process Cartridge evenly | On 6 sides of Heat Storage Member |
| 5 | Above Process Cartridge collectively | On 6 sides of Heat Storage Member |
| 6 | below Process Cartridge collectively | On 6 sides of Heat Storage Member |

Condition 1 represents the comparative example illustrated in FIG. 8 described above, in which neither the latent heat storage member 70 nor the heat insulating member 80 is provided.

Figure 11:
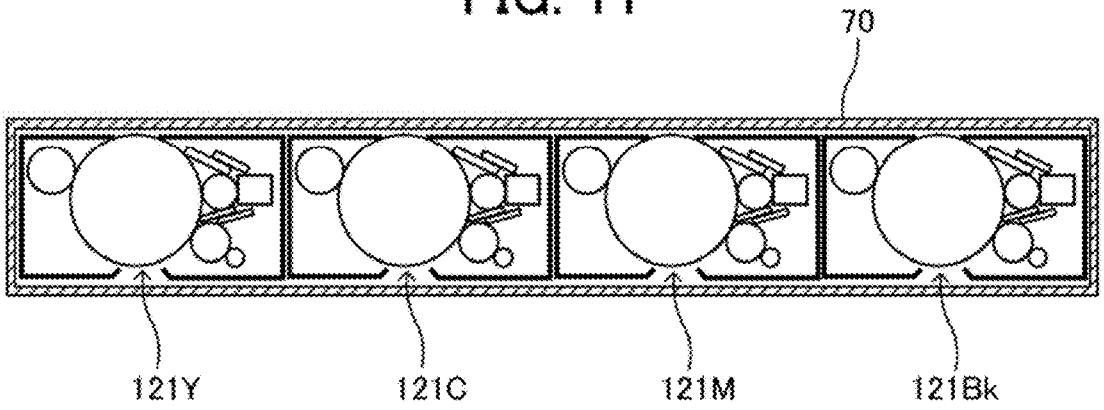
FIG. 11 is a schematic view illustrating an arrangement of the latent heat storage member under Condition 2 in Table 1.

FIG. 11 is a schematic view illustrating the arrangement of Condition 2 in Table 1. As illustrated in FIG. 11, Condition 2 represents the arrangement in which the latent heat storage member 70 is arranged on the six peripheral faces of the four process cartridges 121Y, 121C, 121M, and 121Bk to cover the process cartridges 121Y, 121C, 121M, and 121Bk.

Figure 12:
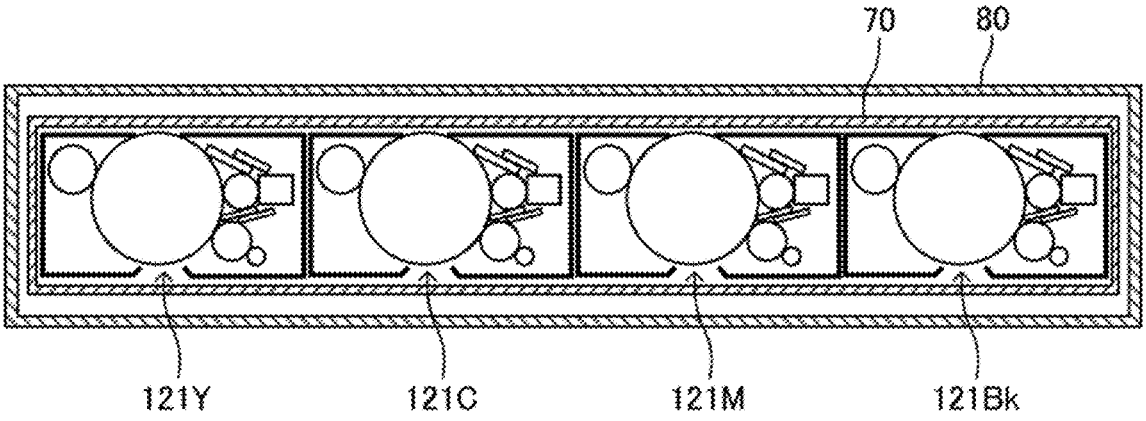
FIG. 12 is a schematic view illustrating an arrangement of the latent heat storage member and the heat insulating member under Condition 3 in Table 1.

FIG. 12 is a schematic view illustrating the arrangement of Condition 3 in Table 1. As illustrated in FIG. 12, Condition 3 represents the arrangement in which the latent heat storage member 70 is arranged on the six peripheral faces of the four process cartridges 121Y, 121C, 121M, and 121Bk, and the heat insulating member 80 is arranged further outside the six peripheral faces to doubly cover the process cartridges 121Y, 121C, 121M, and 121Bk.

Figure 13:
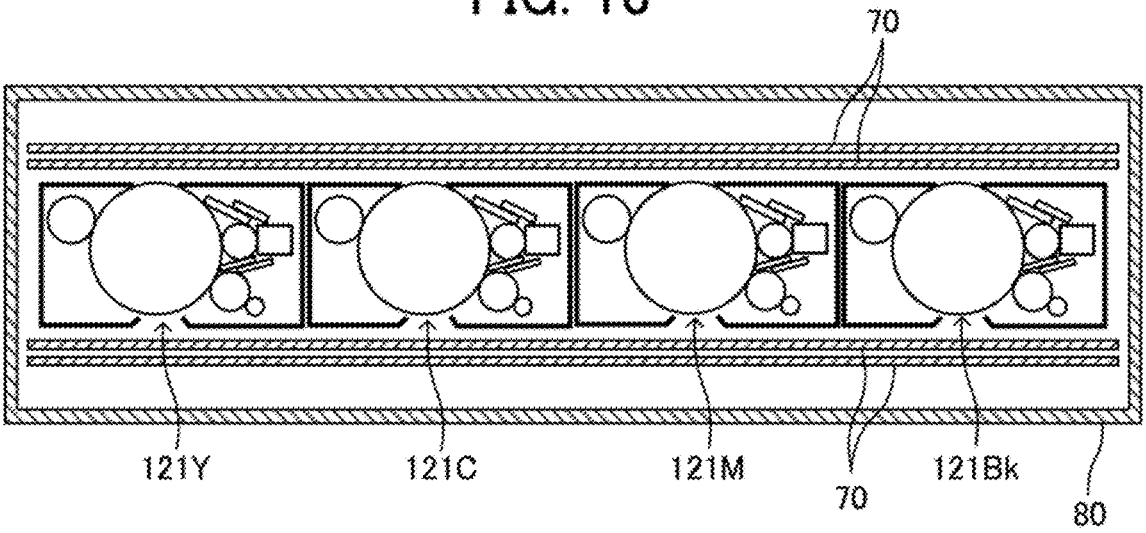
FIG. 13 is a schematic view illustrating an arrangement of the latent heat storage member and the heat insulating member under Condition 4 in Table 1.

FIG. 13 is a schematic view illustrating the arrangement of Condition 4 in Table 1. As illustrated in FIG. 13, Condition 4 represents the arrangement in which the latent heat storage member 70 is arranged above and below the process cartridges 121Y, 121C, 121M, and 121Bk evenly, and the heat insulating member 80 is arranged further outside the six peripheral faces to cover the process cartridges 121Y, 121C, 121M, and 121Bk and the latent heat storage member 70.

Figure 14:
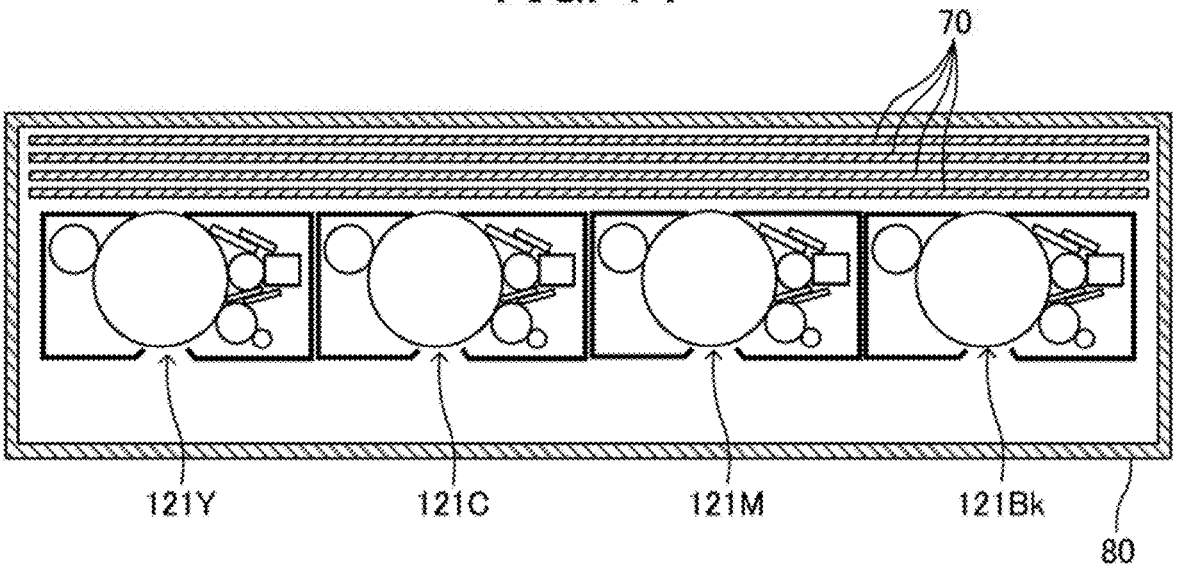
FIG. 14 is a schematic view illustrating an arrangement of the latent heat storage member and the heat insulating member under Condition 5 in Table 1.

FIG. 14 is a schematic view illustrating the arrangement of Condition 5 in Table 1. As illustrated in FIG. 14, Condition 5 represents the arrangement in which the latent heat storage member 70 is arranged above the process cartridges 121Y, 121C, 121M, and 121Bk collectively, and the heat insulating member 80 is arranged further outside the six peripheral faces to cover the process cartridges 121Y, 121C, 121M, and 121Bk and the latent heat storage member 70.

Figure 15:
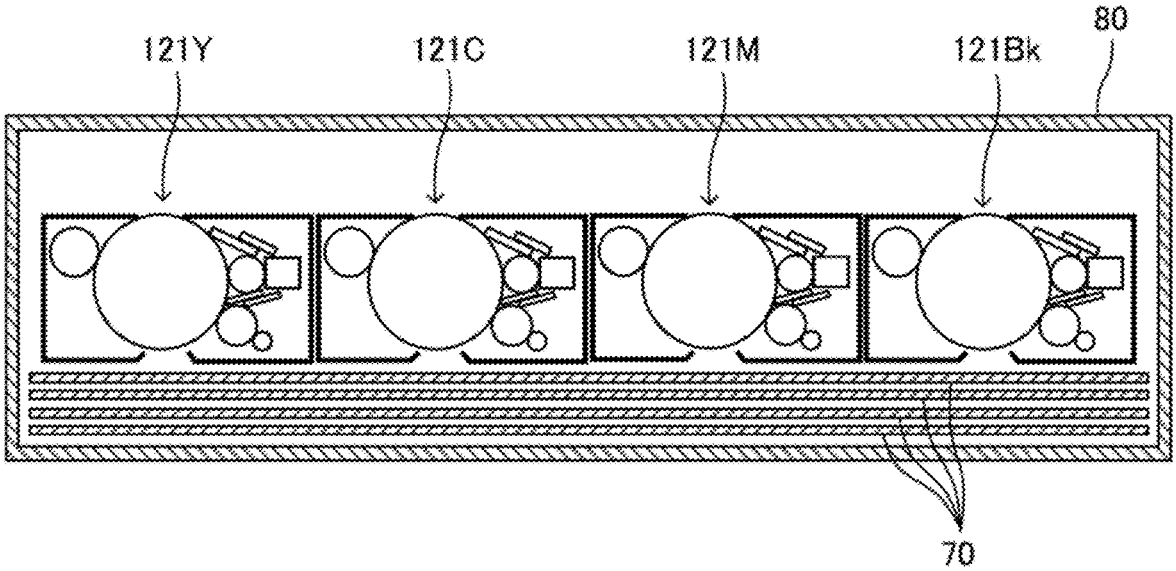
FIG. 15 is a schematic view illustrating an arrangement of the latent heat storage member and the heat insulating member under Condition 6 in Table 1.

FIG. 15 is a schematic view illustrating the arrangement of Condition 6 in Table 1. As illustrated in FIG. 15, Condition 6 represents the arrangement in which the latent heat storage member 70 is arranged below the process cartridges 121Y, 121C, 121M, and 121Bk collectively, and the heat insulating member 80 is arranged further outside the six peripheral faces to cover the process cartridges 121Y, 121C, 121M, and 121Bk and the latent heat storage member 70.

In the arrangements of Conditions 2 to 6 described above, the latent heat storage member 70 and the heat insulating member 80 have openings on the upper side thereof so as to allow the photoconductors 10Y, 10C, 10M, and 10Bk to contact the intermediate transfer belt 162, and have through holes on the lower side thereof so as to allow the exposure device 140 to irradiate the photoconductors 10Y, 10C, 10M, and 10Bk with laser beams.

Figure 16:
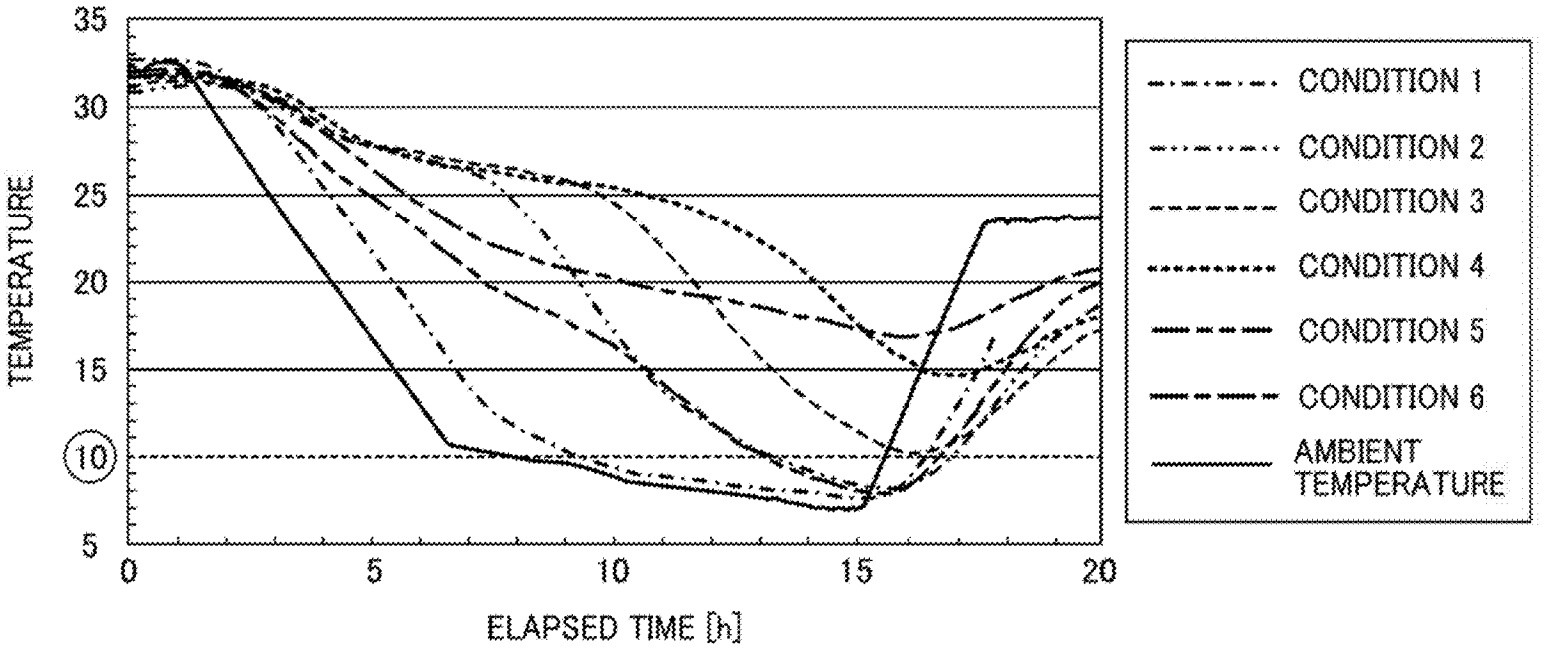
FIG. 16 is a graph illustrating results of experiments.

FIG. 16 is a graph illustrating results of experiments. As illustrated in FIG. 16, in Condition 2 in which the process cartridges 121 is covered with the latent heat storage member 70, after the ambient temperature outside the image forming apparatus 100 drops to 10° C. or less, it takes 5.5 hours until the temperature of the charging roller 41 reaches 10° C. This result is similar to that of the first embodiment illustrated in FIG. 8 in which the latent heat storage member 70 is disposed below the process cartridges 121.

In Condition 3 in which the process cartridges 121 is covered with the latent heat storage member 70 and the heat insulating member 80, the result is similar to that of the second embodiment illustrated in FIG. 8 in which the latent heat storage member 70 and the heat insulating member 80 are disposed below the process cartridges 121.

In Condition 5 in which the latent heat storage member 70 is arranged only above the process cartridges 121, the temperature of the charging roller 41 drops quickly as compared with Condition 4 in which the latent heat storage member 70 is arranged above and below the process cartridges 121, Condition 6 in which the latent heat storage member 70 is arranged only below the process cartridges 121, and Condition 3 in which the latent heat storage member 70 is arranged on the six peripheral faces of the process cartridges 121. In consideration of all of Conditions 3, 4, and 6 in which at least a part of the latent heat storage member 70 is arranged below the process cartridges 121, the arrangement of the latent heat storage member 70 arranged below the process cartridges 121 is effective.

Figure 17A:
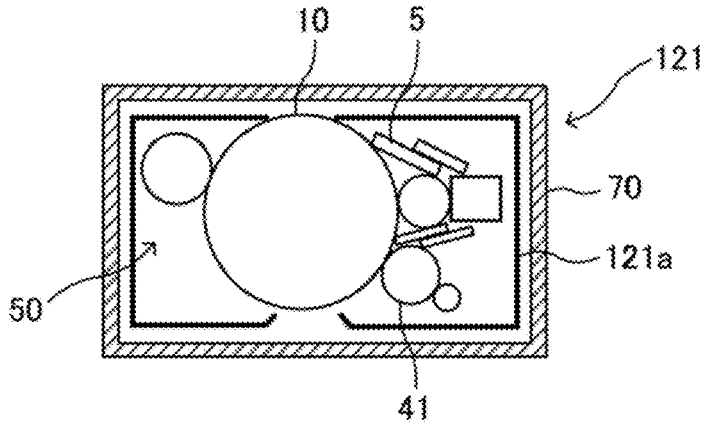
FIGS. 17A to 17C are schematic views of a process cartridge provided with the latent heat storage member according to an embodiment of the present disclosure.
Figure 17B:
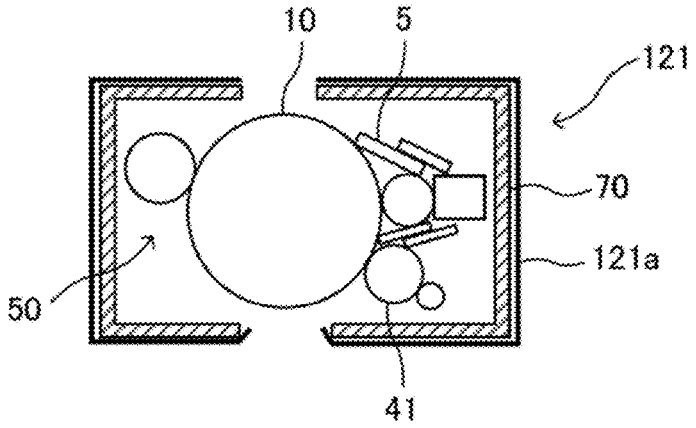
Figure 17C:
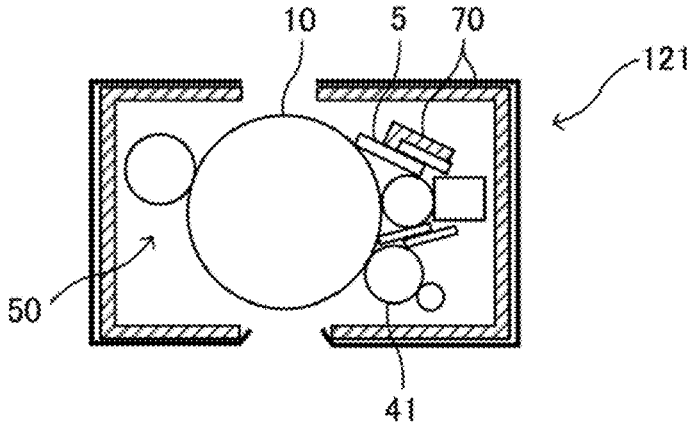

FIGS. 17A to 17C are schematic views of the process cartridge 121 provided with the latent heat storage member 70. FIG. 17A illustrates an example in which the latent heat storage member 70 is installed to the outer peripheral face of a housing 121*a* of the process cartridge 121, and FIG. 17B illustrates another example in which the latent heat storage member 70 is installed to the inner peripheral face of the housing 121*a* of the process cartridge 121. FIG. 17C illustrates yet another example in which the latent heat storage member 70 is installed to the inner peripheral face of the housing 121*a* of the process cartridge 121, and in addition, the latent heat storage member 70 is disposed in contact with the cleaning blade 5 which is the key part.

As illustrated in FIGS. 17A and 17B, the process cartridge 121 is provided with the latent heat storage member 70. Therefore, the latent heat storage member 70 can be located closer to the key parts of the process cartridge 121 as compared with the arrangement in which the latent heat storage member 70 is arranged around the process cartridges 121. The key parts are the target components subjected to temperature change suppression, which are at least one of the photoconductor 10, the developing device 50, the cleaning blade 5, and the charging roller 41. With this configuration, the temperature drop of the key parts can be further suppressed for a long time. For still yet another example, the latent heat storage member 70 can be installed to the inner peripheral face of the housing 121*a* of the process cartridge 121, and the heat insulating member 80 van be installed to the outer peripheral face of the housing 121*a* of the process cartridge 121. With this configuration, the heat insulating member prevents the heat transfer between the air outside the process cartridge 121 and the air inside the process cartridge 121 warmed by heat released when the latent heat storage member 70 solidifies. Accordingly, the temperature inside the process cartridge 121 can be kept constant for a long time, and the temperature drop of the key parts can be suppressed.

In FIG. 17C, the latent heat storage member 70 is attached to the cleaning blade 5 which is the key part. When the temperature inside the image forming apparatus 100 drops, the latent heat storage member 70 can directly applies heat to the cleaning blade 5. Therefore, the temperature drop of the cleaning blade 5 can be reliably suppressed.

Figure 18:
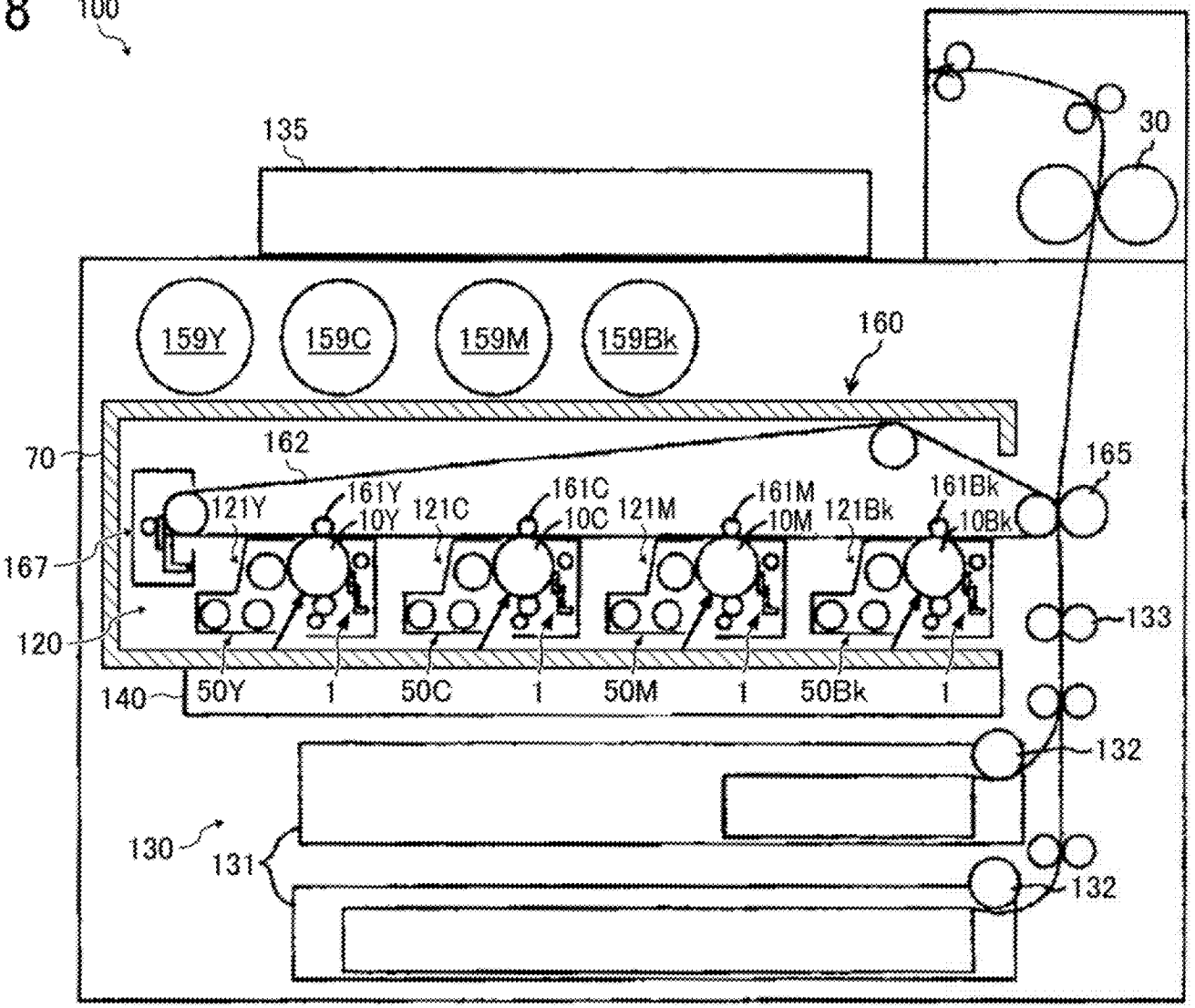
FIG. 18 is a schematic view illustrating a configuration of an image forming apparatus in which a latent heat storage member covers the four process cartridge and an intermediate transfer unit according to an embodiment of the present disclosure.

FIG. 18 is a schematic view illustrating the configuration of the image forming apparatus 100 in which the latent heat storage member 70 covers the intermediate transfer unit 160 and the image forming section 120 including the four process cartridges 121. With this configuration illustrated in FIG. 18, the temperature drop of the cleaning blade of the belt cleaning device 167, the intermediate transfer belt 162, and the primary transfer rollers 161 included in the intermediate transfer unit 160 can be suppressed. As a result, the change in electrical characteristics due to the temperature drop of the intermediate transfer belt 162 or the primary transfer roller 161 can be suppressed, thereby preventing the deterioration of the primary transfer performance and the secondary transfer performance at a low temperature. Further, the change in rubber hardness or elasticity of the cleaning blade of the belt cleaning device 167 due to the temperature drop can be suppressed.

For example, an office is closed on Saturdays and Sundays. The air conditioning is cut off for 62 hours after the work is finished at 18:00 on Friday until 8:00 am on Monday. Meanwhile, the temperature in the office continues dropping. As a result, the latent heat storage member 70 has also been cooled, and the temperature of both the latent heat storage member 70 and the key parts has dropped to the ambient temperature outside the image forming apparatus 100. When the image forming apparatus 100 is used from such a state, a part of heat generated in the image forming apparatus 100 is absorbed by the latent heat storage member 70, and it takes time for the temperature of the key parts to rise to a temperature (for example, 10° C.) that does not affect images.

Therefore, preferably, the latent heat storage member 70 is removably installed to the image forming apparatus 100. With this configuration, for example, when the temperature of the key parts has dropped below a predetermined temperature and is required to rise the predetermined temperature, the latent heat storage member 70 is removed from the image forming apparatus 100. Accordingly, the temperature of the key parts can quickly rise to the predetermined temperature, thereby preventing image defects due to the temperature drop of the key parts.

Further, since the latent heat storage member 70 is removably installable to the image forming apparatus 100, the latent heat storage member 70 can be appropriately provided as required. For example, when the image forming apparatus 100 is used in a warm district and the ambient temperature outside the image forming apparatus 100 does not drop to 10° C. or less, the latent heat storage member 70 is not installed to the image forming apparatus 100.

Figure 19:
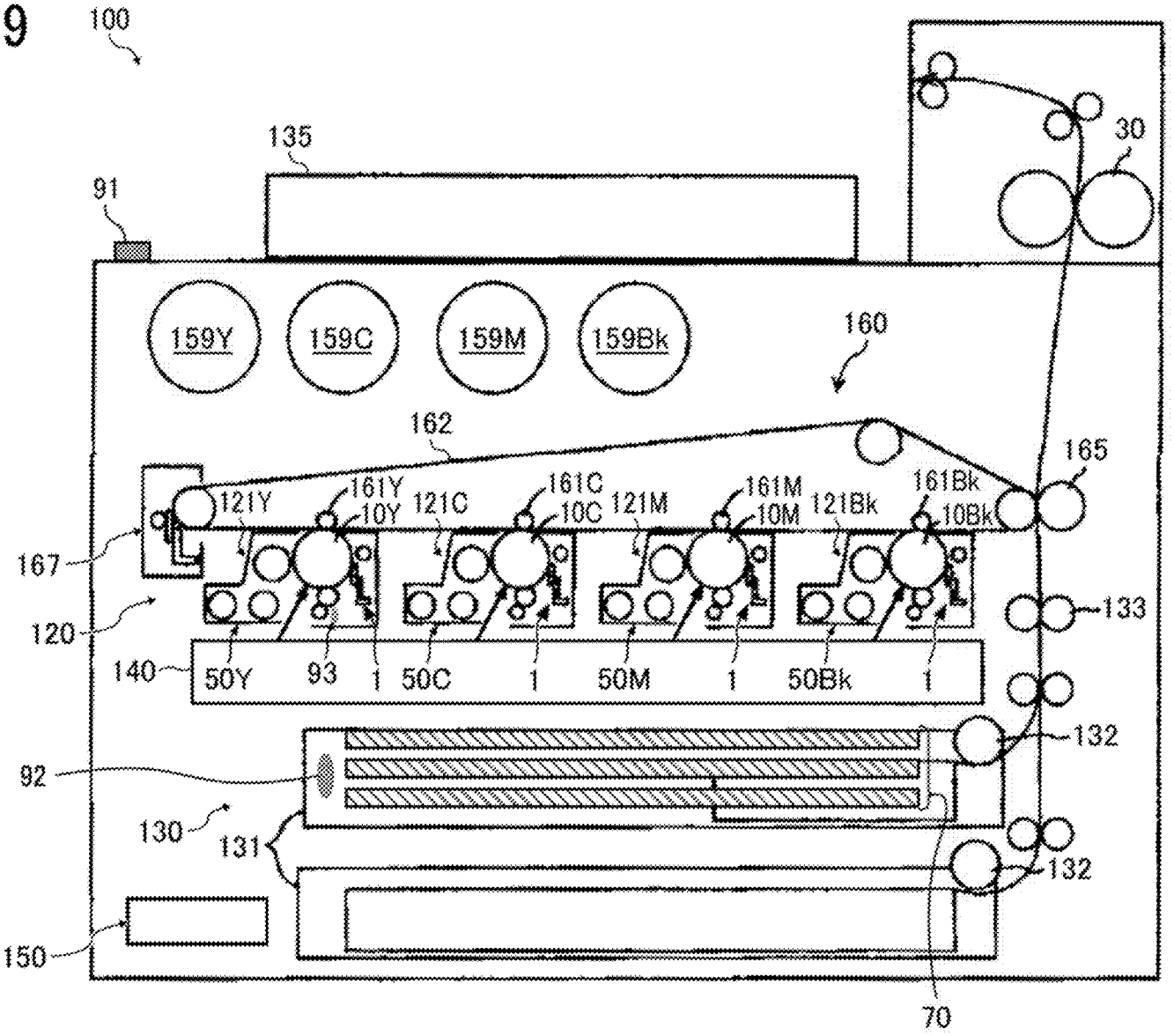
FIG. 19 is a schematic view illustrating a configuration of an image forming apparatus in which a latent heat storage member is accommodated in a sheet tray according to an embodiment of the present disclosure.

FIG. 19 is a schematic view illustrating the configuration of the image forming apparatus 100 in which the latent heat storage member 70 is accommodated in the sheet tray 131 as the configuration example in which the latent heat storage member 70 is removably installable.

In recent years, image forming apparatuses have been downsized, and it is difficult to secure space around process cartridges 121. Therefore, the latent heat storage member 70 arranged in the sheet tray 131 can effectively use space. Further, the latent heat storage member 70 is removably installable to the image forming apparatus 100 by using an existing configuration (i.e., the sheet tray 131).

Further, as illustrated in FIG. 19, the latent heat storage member 70 is preferably accommodated in the top sheet tray 131. With this configuration, the latent heat storage member 70 can be located as close to the process cartridges 121 as possible. The process cartridge 121 includes the key parts (e.g., the photoconductor 10, the developing device 50, the charging roller 41, and the cleaning blade). Therefore, as compared with the case in which the latent heat storage member 70 is accommodated in the sheet tray 131 other than the top sheet tray 131, the temperature drop of the key parts can be suppressed.

In FIG. 19, the latent heat storage member 70 is disposed below the process cartridges 121. As the ambient temperature outside the image forming apparatus 100 drops, the temperature inside the image forming apparatus 100 drops. The air warmed by the heat released when the latent heat storage member 70 solidifies rises and contacts the key parts of the process cartridges 121, thereby suppressing the temperature drop of the key parts.

In the configuration illustrated in FIG. 19, the image forming apparatus 100 includes an outside temperature sensor 91 that detects the outside temperature $T_{OUT}$ outside the image forming apparatus 100, a storage member sensor 92 that detects the temperature $T_{LHS}$ of the latent heat storage member 70, and a key parts sensor 93 that detects the temperature $T_{CH}$ around the key parts. The image forming apparatus 100 further includes a controller 150 as circuitry that determine whether to remove or install the latent heat storage member 70 and prompts a user to remove or install the latent heat storage member 70 based on the detection results of the above-described sensors 91, 92, and 93.

For example, when the image forming apparatus 100 is turned on, the controller 150 checks the outside temperature $T_{OUT}$ detected by the outside temperature sensor 91. When the outside temperature $T_{OUT}$ is equal to or less than a predetermined temperature (for example, 10° C. or less), the controller 150 checks the temperature $T_{LHS}$ detected by the storage member sensor 92 and compares the temperature $T_{LHS}$ and the outside temperature $T_{OUT}$. When the difference between the temperature $T_{LHS}$ and the outside temperature $T_{OUT}$ is lower than a reference value, the latent heat storage member 70 is cold, and the latent heat storage member 70 hinders the temperature of the key parts from rising. Therefore, at this time, the controller 150 causes a touch panel, which is the control panel of the image forming apparatus 100, to display an instruction to remove the latent heat storage member 70 from the sheet tray 131. By removing the latent heat storage member 70, heat is not absorbed by the latent heat storage member 70, and the temperature of the key parts can quickly rise.

Further, when the temperature $T_{CH}$ around the key parts detected by the key parts sensor 93 becomes equal to or more than the predetermined temperature and the temperature of the key parts rises to a level at which the image is not affected, the controller 150 causes the touch panel to display an instruction to install the latent heat storage member 70 to the sheet tray 131.

In the above description, the instruction to remove or install the latent heat storage member 70 is displayed on the touch panel, but may be given by voice.

Alternatively, when the outside temperature $T_{OUT}$ is equal to or less than the predetermined temperature (for example, 10° C. or less), the controller 150 checks the temperature $T_{CH}$ detected by the key parts sensor 93, and prompts a user to remove the latent heat storage member 70 from the sheet tray 131 when the temperature $T_{CH}$ is equal to or less a reference value (for example, 10° C. or less).

In another embodiment, only the key parts sensor 93 may be provided. When the image forming apparatus 100 is turned on, the controller 150 checks the temperature $T_{CH}$ detected by the key parts sensor 93, and prompts a user to remove the latent heat storage member 70 from the sheet tray 131 when the temperature $T_{CH}$ is equal to or less the reference value (for example, 10° C. or less).

In the configuration in which the latent heat storage member 70 is accommodated in the sheet tray 131, if the latent heat storage member 70 is erroneously fed to a sheet conveyance path, the pack filled with the latent heat storage member 70 may be damaged, or a conveyance roller such as the sheet feeding roller 132 may be damaged. Therefore, in the present embodiment, defective sheet feeding of the latent heat storage member 70 is inhibited by at least one of the following methods.

In Method 1, a user designates the sheet tray 131 to accommodate the latent heat storage member 70, using the touch panel as the control panel of the image forming apparatus 100. When image formation is performed, the controller 150 sets the sheet tray 131 designated by the user not to be selectable so as to inhibit the sheet tray 131 from feeding. As a result, the latent heat storage member 70 is prevented from being erroneously fed to the sheet conveyance path.

In Method 2, the latent heat storage member 70 is made thicker than the transfer sheet so that the latent heat storage member 70 does not enter the sheet conveyance path. This method can also prevent the latent heat storage member 70 from being erroneously fed to the sheet conveyance path.

In Method 3, the latent heat storage member 70 is provided with a hole or a cutout. With this configuration, when the latent heat storage member 70 is set in the sheet tray 131, the latent heat storage member 70 does not face the sheet feeding roller 132 so as not to contact the sheet feeding roller 132. This method can also prevent the latent heat storage member 70 from being erroneously fed to the sheet conveyance path. Alternatively, the bottom plate of the sheet tray 131 may be locked so as not to rise, thereby preventing the latent heat storage member 70 from contacting the sheet feeding roller 132.

In Method 4, a capacitance sensor is provided in the sheet tray 131. The capacitance of the transfer sheet is greatly different from the capacitance of the latent heat storage member 70. Using this fact, the controller 150 determines whether the sheet tray 131 accommodates the latent heat storage member 70 or the transfer sheet based on the capacitance detected by the capacitance sensor. In this method, when the controller 150 determines that the latent heat storage member 70 is set in the sheet tray 131, the controller 150 sets the sheet tray 131 not to be selectable during image formation so as to inhibit the sheet tray 131 from feeding. As a result, the latent heat storage member 70 is prevented from being erroneously fed to the sheet conveyance path.

In Method 5, the controller 150 determines whether the sheet tray 131 accommodates the latent heat storage member 70 or the transfer sheet based on the difference between the load torque for feeding the transfer sheet and the load torque for feeding the latent heat storage member 70. In this method, when the sheet tray 131 is closed, the feeding operation is performed. When the load torque is equal to or more than a reference value, the controller 150 determines that the latent heat storage member 70 is set in the sheet tray 131 and sets the sheet tray 131 not to be selectable during image formation so as to inhibit the sheet tray 131 from feeding. As a result, the latent heat storage member 70 is prevented from being erroneously fed to the sheet conveyance path.

In Method 6, an optical sensor is provided in the sheet tray 131. The controller 150 determines whether the sheet tray 131 accommodates the latent heat storage member 70 or the transfer sheet based on the difference between the reflectance of the transfer sheet and the reflectance of the latent heat storage member 70. In this method, when the controller 150 determines that the latent heat storage member 70 is set in the sheet tray 131, the controller 150 sets the sheet tray 131 not to be selectable during image formation so as to inhibit the sheet tray 131 from feeding. As a result, the latent heat storage member 70 is prevented from being erroneously fed to the sheet conveyance path.

In Method 7, the latent heat storage member 70 is provided with a conductive terminal on the pack thereof, and detecting terminals are disposed in the sheet tray 131. When the latent heat storage member is set in the sheet tray 131, the detecting terminals contact the conductive terminal to conduct via the conductive terminal. A signal indicating the conduction of the detecting terminals is transmitted to the controller 150 of the image forming apparatus 100, and the controller 150 determines whether or not the latent heat storage member 70 is set in the sheet tray 131. In this method, when the controller 150 determines that the latent heat storage member 70 is set in the sheet tray 131, the controller 150 sets the sheet tray 131 not to be selectable during image formation so as to inhibit the sheet tray 131 from feeding. As a result, the latent heat storage member 70 is prevented from being erroneously fed to the sheet conveyance path.

In Methods 2 and, 3, the latent heat storage member 70 can be prevented from being erroneously fed without an additional configuration in the image forming apparatus 100 and with a low cost. However, if the sheet tray 131 in which the latent heat storage member 70 is set is mistakenly selected during image formation, the transfer sheet does not pass through the predetermined position at the predetermined timing. As a result, a sheet jam error occurs, and the image formation is stopped.

On the other hand, in Methods 4 to 7, since the controller 150 inhibits the sheet tray 131 in which the latent heat storage member 70 is set from feeding, the sheet jam error does not occur unlike Methods 2 and 3. In Methods 4 to 7, additional components are required for determining whether the latent heat storage member 70 is set or the transfer sheet is set, thereby increasing the number of components.

Method 1 is preferable because the defective sheet feeding of the latent heat storage member 70 can be prevented without an additional configuration in the image forming apparatus 100, and the sheet jam error does not occur unlike Methods 2 and 3.

Figure 20:
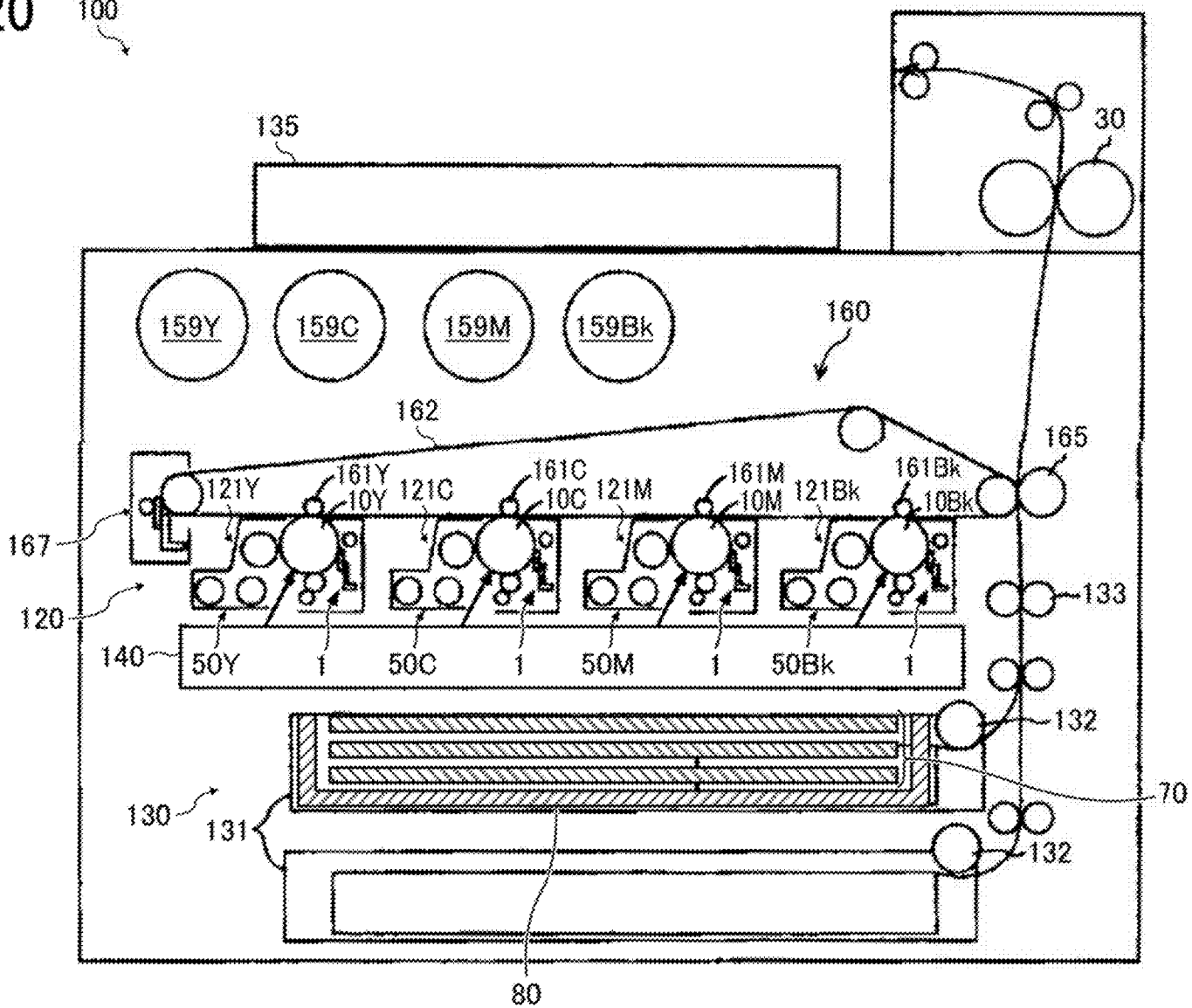
FIG. 20 is a schematic view illustrating a configuration of an image forming apparatus in which a latent heat storage member and a heat insulating member are accommodated in a sheet tray according to an embodiment of the present disclosure.

Further, as illustrated in FIG. 20, the latent heat storage member 70 and the heat insulating member 80 can be accommodated in the sheet tray 131. The heat insulating member 80 has an open-topped box shape, and the latent heat storage member 70 is housed in the heat insulating member 80 accommodated in the sheet tray 131. With this configuration, the heat transfer between the latent heat storage member 70 and the cool air that has flowed into the image forming apparatus 100 from outside can be suppressed, thereby suppressing the temperature drop around the latent heat storage member 70. As a result, the temperature drop of the latent heat storage member 70 can be suppressed, and the temperature of the latent heat storage member 70 can remain around the melting point for a long time.

Figure 21:
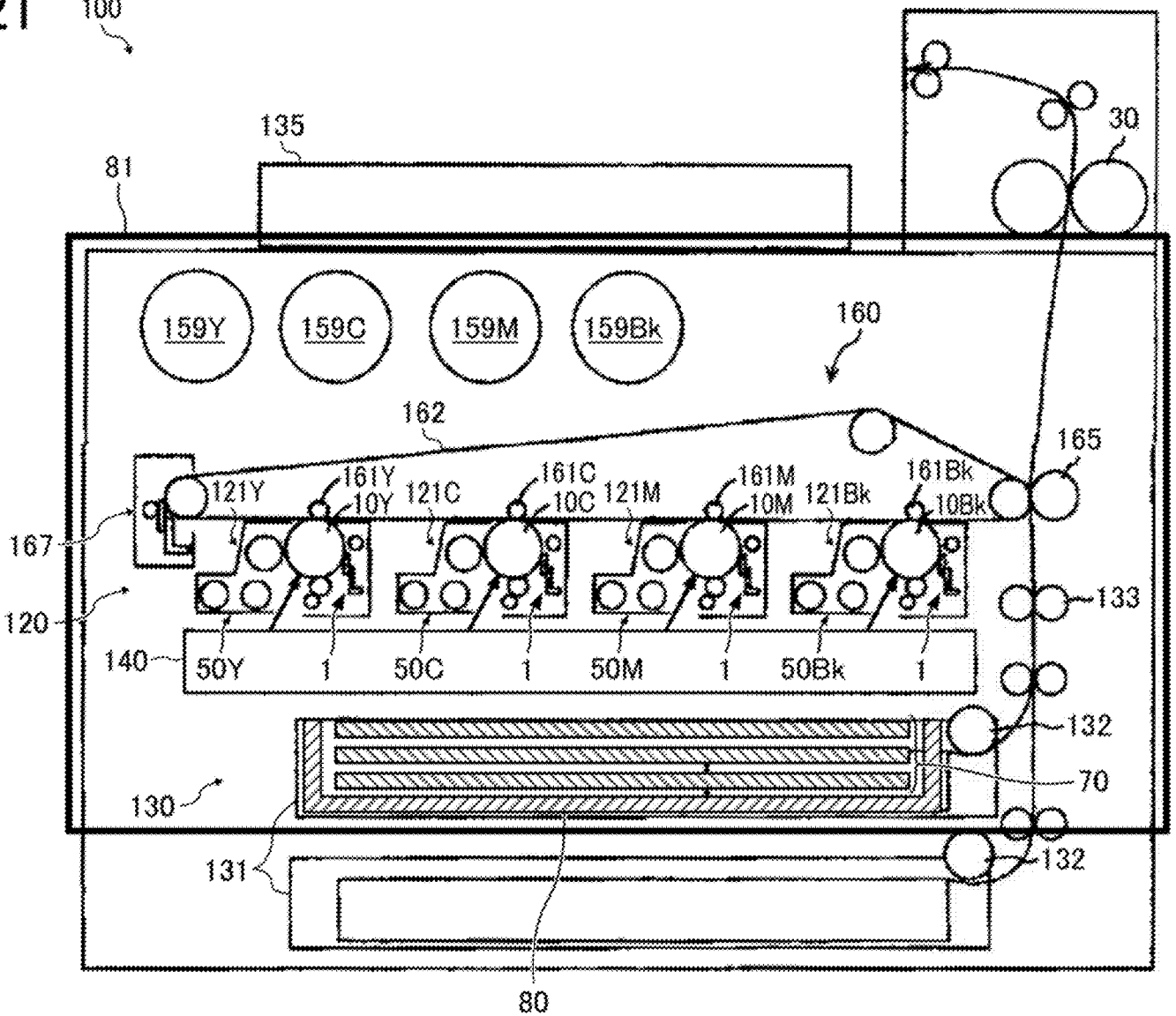
FIG. 21 is a schematic view illustrating a configuration of an image forming apparatus covered by a heat insulating cover according to an embodiment of the present disclosure.

As illustrated in FIG. 21, the image forming apparatus 100 can includes a heat insulating cover 81 as the heat insulating member separately. The heat insulating cover 81 is removably installable to the image forming apparatus 100 and can cover the image forming apparatus 100 after work. In this way, with the heat insulating cover 81 covering the image forming apparatus 100, the temperature of the latent heat storage member 70 changes more slowly, and the temperature inside the image forming apparatus 100 drops slowly, thereby suppressing the temperature drop of the key parts for a long time.

Figure 22:
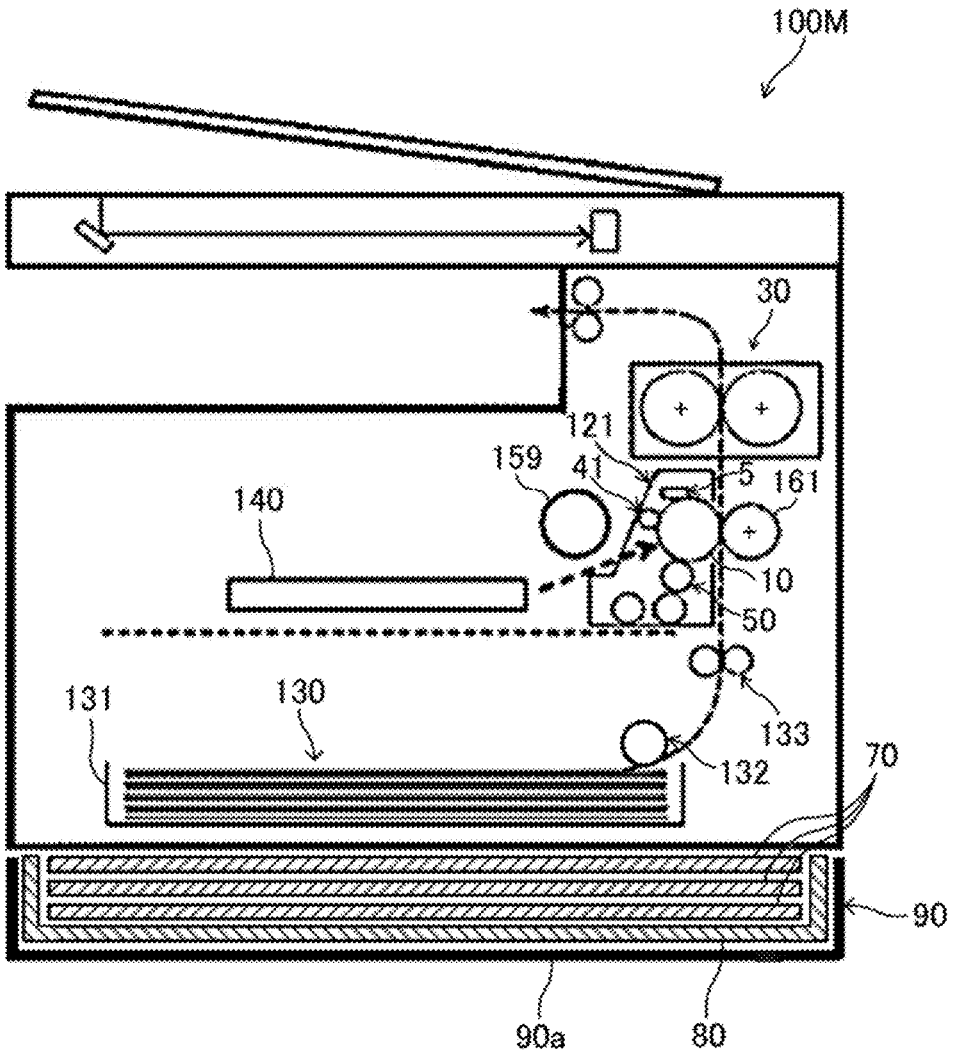
FIG. 22 is a schematic view illustrating a configuration of an image forming apparatus in which a temperature change suppression unit including a latent heat storage member is installed to the lower section of the monochrome image forming apparatus according to an embodiment of the present disclosure.

FIG. 22 is a schematic view illustrating a configuration of an image forming apparatus provided with a temperature change suppression unit 90 including a latent heat storage member 70. The temperature change suppression unit 90 is an optional unit attached to the lower section of the image forming apparatus 100M. The temperature change suppression unit 90 includes an open-topped, box-shaped housing 90*a*. The heat insulating member 80 has an open-topped box shape similar to the housing 90*a* and is accommodated in the housing 90*a*. The latent heat storage member 70 is housed in the heat insulating member 80.

As described above, with temperature change suppression unit 90, the latent heat storage member 70 can be installed to the small and compact image forming apparatus 100M with the single sheet tray 131 and without a space for housing the latent heat storage member 70. Further, with temperature change suppression unit 90, a large amount of latent heat storage member 70 can be housed, enabling to store a large amount of heat. With this configuration, the latent heat storage member 70 can release heat for a long time, thereby suppressing the temperature drop inside the image forming apparatus 100M for a long time.

Figure 23:
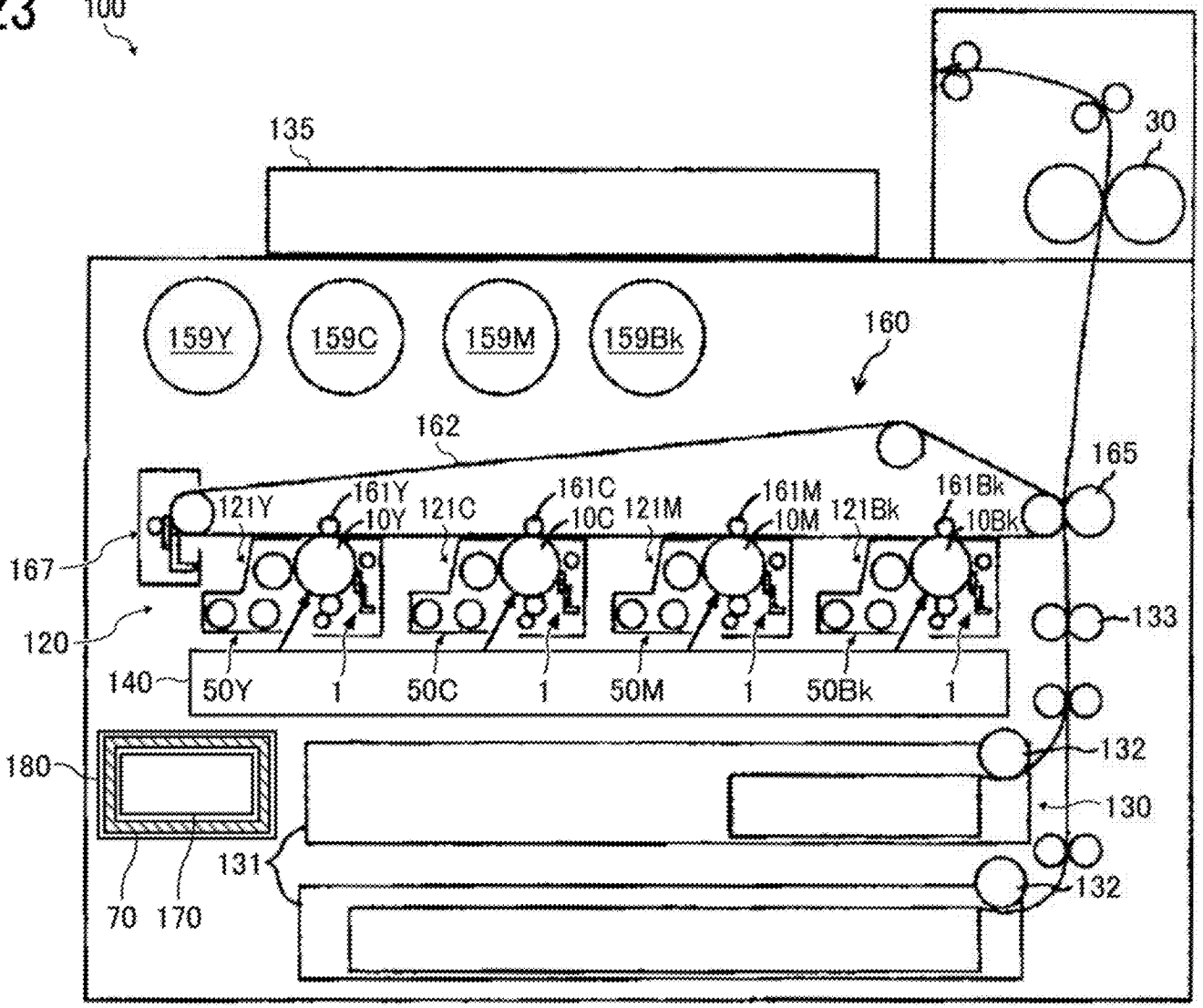
FIG. 23 is a schematic view illustrating a configuration of an image forming apparatus in which a latent heat storage member is installed to an inner wall of a waste toner container mount.

In FIG. 23, the latent heat storage member 70 is installed to the inner wall of a waste toner container mount 180. A waste toner container 170 for storing waste toner is installed in the waste toner container mount 180. When the temperature of the waste toner container 170 becomes high, the waste toner in the waste toner container may melt and block the inlet port of the waste toner container 170 through which waste toner is carried in the waste toner container 170. When the temperature of the waste toner container 170 becomes low, the waste toner in the waste toner container 170 may agglomerate and block the inlet port of the waste toner container 170.

As illustrated in FIG. 23, the latent heat storage member 70 is installed to the inner wall of the waste toner container mount 180, and the waste toner container 170 is covered with the latent heat storage member 70. Accordingly, the temperature inside the waste toner container mount 180 can be maintained at a constant temperature for a long time. Thus, the waste toner in the waste toner container 170 can be prevented from melting and agglomerating.

Further, when the outside temperature of the image forming apparatus 100 becomes low, the latent heat storage member 70 in the waste toner container mount 180 releases heat. The process cartridge 121Y for yellow disposed adjacent to the waste toner container mount 180 is warmed by the heat released from the latent heat storage member 70. As a result, the temperature drop of the key parts (at least one of the photoconductor 10, the developing device 50, the charging roller 41, and the cleaning blade 5) of the process cartridge 121Y can be suppressed.

The embodiments described above are examples and can provide, for example, the following effects, respectively.

Aspect 1

An image forming apparatus includes an image bearer such as the photoconductor 10 configured to bear a latent image, a charging device such as the charging roller 41 configured to charge the image bearer, a developing device such as the developing device 50 configured to develop the latent image on the image bearer, and a cleaning device such as the cleaning blade 5 configured to clean the surface of the image bearer, a target component including at least one of the image bearer, the charging device, the developing device, and the cleaning device, and a temperature change suppression member such as the latent heat storage member 70 opposed adjacent to or disposed in contact with an outer peripheral face of the target component to suppress a temperature change of the target component.

The image forming apparatus used in the office environment is turned off from the end of work to the start of work on the next morning. Air conditioning is also stopped from the end of work to the start of work on the next morning. Therefore, in winter, the image forming apparatus is left in a low temperature environment for a long time, and the temperature of the key parts for image formation such as the image bearer, the charging device, the developing device and the cleaning device may drop to a low temperature. When image formation is started with the temperature of the key parts for image formation lowered, abnormal images may occur due to poor charging, poor cleaning, or the like. Therefore, the temperature drop of at least one of the image bearer, the charging device, the developing device, and the cleaning device is preferably prevented.

In a comparative image forming apparatus, an interior of a target component subjected to temperature change suppression is filled with a temperature change suppression member. When the temperature change suppression member is arranged inside the target component, the cool air in the low temperature environment, which has entered the image forming apparatus, directly contacts the surface of the target component, thereby cooling the target component. As a result, the temperature change suppression member does not sufficiently suppress the temperature change of the target component for a long time.

On the other hand, in Aspect 1, the temperature change suppression member is opposed adjacent to or disposed in contact with the outer peripheral face of the target component. Thus, the temperature change suppression member can insulate the heat dissipated from the target component and prevent the cool outside air that has entered the image forming apparatus from contacting the target component. As a result, the temperature drop of the target component can be suppressed for a long time as compared with the case in which the temperature change suppression member is arranged inside the target component.

Aspect 2

In Aspect 1, the temperature change suppression member is one of the latent heat storage member 70 or the heat insulating member 80.

Accordingly, as described in the above embodiments, as the temperature drops, the latent heat storage member 70 release heat during phase change from liquid to solid. The released heat can suppress the temperature drop of the target component.

The heat insulating member 80 can prevent the heat transfer between the target component or the air around the target component and the outside air having a low temperature that has entered the image forming apparatus, thereby suppressing the heat dissipation from the target component. Therefore, the temperature drop of the target component can be suppressed.

Aspect 3

In Aspect 1 or 2, the temperature change suppression member includes a plurality of temperature change suppression members. At least one of the plurality of temperature change suppression members is a latent heat storage member 70, and the rest of the plurality of temperature change suppression members is the heat insulating member 80.

Accordingly, as described with reference to FIG. 6, the heat insulating member 80 can prevent the heat transfer between the latent heat storage member 70 or the target component and the cool outside air that has entered the image forming apparatus, thereby suppressing the temperature drop of the latent heat storage member 70 and the target component. Since the heat insulating member 80 can suppress the temperature drop of the latent heat storage member 70, the period of the phase change from liquid to solid can be extended, thereby extending the period in which the latent heat storage member 70 releases heat. Thus, the temperature drop of the target component can be suppressed.

Aspect 4

An image forming apparatus includes a target component, and a plurality of temperature change suppression members configured to suppress a temperature change of the target component. At least one of the plurality of temperature change suppression members is a latent heat storage member 70, and the rest of the plurality of temperature change suppression members is a heat insulating member 80.

Accordingly, as described with reference to FIG. 6, the heat insulating member 80 can prevent the heat transfer between the latent heat storage member 70 or the target component and the cool outside air that has entered the image forming apparatus, thereby suppressing the temperature drop of the latent heat storage member 70 and the target component. Since the heat insulating member 80 can suppress the temperature drop of the latent heat storage member 70, the period of the phase change from liquid to solid can be extended, thereby extending the period in which the latent heat storage member 70 releases heat. Thus, the temperature drop of the target component can be suppressed.

Aspect 5

In Aspect 4, the latent heat storage member and the heat insulating member are disposed adjacent to the target component.

Accordingly, as described with reference to FIG. 6, the latent heat storage member 70 can efficiently applies the released heat to the target component, thereby suppressing the temperature drop of the target component. The heat insulating member 80 can prevent the heat transfer between the air around the target component and the cool outside air that has entered the image forming apparatus. Therefore, the temperature drop of the target component can be suppressed.

Aspect 6

In any one of Aspects 3 to 5, the heat insulating member 80 is disposed outboard of the latent heat storage member 70 with respect to the target component.

Accordingly, as described with reference to FIG. 6, the heat insulating member 80 does not hinder the heat transfer between the latent heat storage member 70 and the target component and can block the heat transfer between the latent heat storage member 70 and the target component, and the cool air that has entered the image forming apparatus. Thus, the temperature drop of the target component can be suppressed.

Aspect 7

In any one of Aspects 1 to 6, the temperature change suppression member is disposed extending over the entire area of the target component in a longitudinal direction of the target component.

Accordingly, as described in the above embodiments, the temperature change suppression member such as the latent heat storage member 70 can cover the entire area of the target component in the longitudinal direction of the target component, thereby suppressing the temperature drop of the target component.

Aspect 8

In any one of Aspects 1 to 7, the temperature change suppression member is disposed below the target component in the vertical direction.

As described in the above embodiments, the cool air outside the image forming apparatus enters from the lower side of the image forming apparatus. Therefore, the air inside the image forming apparatus is progressively cooled from the lower side thereof. In the case in which the temperature change suppression member is the heat insulating member 80, the heat insulating member 80 can block the heat transfer between the target component and the cool air on the lower side of the image forming apparatus. Therefore, the temperature drop of the target component can be suppressed.

In the case in which the temperature change suppression member is the latent heat storage member 70, the air around the latent heat storage member 70 is warmed by the heat released during phase change from liquid to solid, rises, and contacts the target component, thereby warming the target component. Thus, the temperature change of the target component can be suppressed.

Aspect 9

In any one of Aspects 1 to 8, the image forming apparatus further includes an image forming unit such as the process cartridge 121 removably installed in the image forming apparatus. The image forming unit holds the image bearer such as the photoconductor 10, the charging device such as the charging roller 41 to charge the image bearer, the developing device such as the developing device 50 to develop the latent image on the image bearer, and the cleaning device such as the cleaning blade 5 to clean the surface of the image bearer as a single unit. The temperature change suppression member is installed to the image forming unit.

Accordingly, as described with reference to FIG. 17, the temperature change suppression member such as the latent heat storage member 70 can be disposed adjacent to the target component, which is at least one of the image bearer such as the photoconductor 10, the charging device such as the charging roller 41, the developing device such as the developing device 50, and the cleaning device such as the cleaning blade 5 included in the image forming unit such as the process cartridge 121. Thus, the temperature drop of the target component of the image forming unit can be satisfactorily suppressed.

Aspect 10

In Aspect 9, the temperature change suppression member includes a plurality of temperature change suppression members. At least one of the plurality of temperature change suppression members is a latent heat storage member 70, and the rest of the plurality of temperature change suppression members is the heat insulating member 80.

Accordingly, the heat insulating member 80 can block the heat transfer between the latent heat storage member 70 or the target component inside the process cartridge, and the air outside the process cartridge, thereby suppressing the temperature drop of the latent heat storage member 70 and the target component. Since the heat insulating member 80 can suppress the temperature drop of the latent heat storage member 70, the period of the phase change from liquid to solid can be extended, thereby extending the period in which the latent heat storage member 70 releases heat. Thus, the temperature drop of the target component can be suppressed.

Aspect 11

An image forming apparatus includes a target component and a temperature change suppression member to suppress a temperature change of the target component. The temperature change suppression member is removably installed to the image forming apparatus.

As described with reference to FIG. 19, when the image forming apparatus is stopped for a long time in a low temperature environment, the temperature of the target component and the latent heat storage member 70 also drops to almost the ambient temperature. Preferably, the temperature of the target component quickly rise to the predetermined temperature when the image forming apparatus is booted up in such a state.

In the case in which the temperature change suppression member is the latent heat storage member 70, the latent heat storage member 70 absorbs a part of the heat generated by driving the image forming apparatus, and the heat applied to the target component is reduced. Therefore, it takes time for the target component to rise to the predetermined temperature. In the case in which the temperature change suppression member is the heat insulating member 80, the heat insulating member 80 blocks the heat transfer between the target component and the heat generated by driving the image forming apparatus, and the heat applied to the target component is reduced. Therefore, it takes time for the target component to rise to the predetermined temperature.

In the aspect 11, since the temperature change suppression member is removably installable to the image forming apparatus, when the temperature of the temperature change suppression member or the target component is low, the temperature change suppression member can be removed from the image forming apparatus. Thus, the temperature of the target component can quickly rise to the predetermined temperature. The temperature change suppression member is installed to the image forming apparatus when the target component rises to the predetermined temperature or when the image forming apparatus is left in a low temperature environment for a long time. Thus, the temperature drop of the target component can be suppressed when the image forming apparatus is left in the low temperature environment for several hours.

Aspect 12

In Aspect 11, the image forming apparatus further includes a plurality of sheet trays 131 that accommodates a recording medium such as the transfer sheet. At least one of the plurality of sheet trays 131 accommodates the temperature change suppression member.

Accordingly, as described with reference to FIG. 19, the temperature change suppression member is removably installable to the image forming apparatus 100 by using an existing configuration (i.e., the sheet tray 131). Further, the temperature change suppression member arranged in the sheet tray 131 can effectively use space.

Aspect 13

In Aspect 12, a top sheet tray 131 of the plurality of sheet trays 131 accommodates the temperature change suppression member.

Accordingly, as described with reference to FIG. 19, the latent heat storage member 70 can be located as close to the image forming unit as possible. The process cartridge 121 as the image forming unit includes the key parts that affect images due to the temperature drop (e.g., the photoconductor 10, the developing device 50, the charging roller 41, and the cleaning blade 5). Therefore, as compared with the case in which the temperature change suppression member is accommodated in the sheet tray 131 other than the top sheet tray 131, the temperature drop of the key parts can be suppressed.

Aspect 14

In any one of Aspects 11 to 13, the image forming apparatus further includes a temperature sensor that detects at least one of an outside temperature, a temperature of the temperature change suppression member, and a temperature of the target component, and circuitry such as the controller 150 that prompts to remove or install the temperature change suppression member based on the at least one of the outside temperature, the temperature of the temperature change suppression member, and the temperature of the target component. The temperature change suppression member is a latent heat storage member 70.

Accordingly, as described with reference to FIG. 19, when the outside temperature is low and the temperature of the temperature change suppression member or the temperature of the target component is low, the circuitry can prompt a user to remove the temperature change suppression member from the image forming apparatus. Thus, the temperature of the target component can quickly rise to the predetermined temperature. The circuitry can prompt a user to install the temperature change suppression member to the image forming apparatus when the target component rises to the predetermined temperature.

Aspect 15

In Aspect 14, the circuitry compares the outside temperature and the temperature of the temperature change suppression member and prompts to remove or install the temperature change suppression member based on the comparison result of the outside temperature and the temperature of the temperature change suppression member.

If there is almost no difference between the outside temperature and the temperature of the temperature change suppression member, the temperature change suppression member has solidified and finished releasing heat. The temperature of the target component is likely to drop to about the same as the outside temperature. If the temperature of the temperature change suppression member is sufficiently higher than the outside temperature, the phase change from liquid to solid is likely to be in progress. Accordingly, the temperature change suppression member releases heat, and the released heat warms the target component. That is, the temperature of the target component is unlikely to be low.

By comparing the outside temperature and the temperature of the temperature change suppression member, the circuitry can estimate the temperature of the target component and prompt to remove or install the temperature change suppression member properly.

Aspect 16

An image forming apparatus includes an image forming device to form a toner image on a recording medium, a waste toner container 170 to store waste toner generated in the image forming device, a waste toner container mount 180 to accommodate the waste toner container 170, and a temperature change suppression member installed to the waste toner container mount 180. In the above-described embodiment, the image forming device is constructed of the image forming section 120 and the intermediate transfer unit 160.

Accordingly, as described with reference to FIG. 23, the temperature change inside the waste toner container 170 can be suppressed, thereby preventing the waste toner in the waste toner container 170 from melting and agglomerating.

Aspect 17

In any one of aspects 1 to 16, the temperature change suppression member is a latent heat storage member having a melting point of 20° C. or more and 30° C. or less.

Accordingly, as described in the above embodiments, the latent heat storage member 70 can remain in liquid phase at the temperature inside the image forming apparatus in use.

Aspect 18

In any one of Aspects 1 to 16, the temperature change suppression member is a latent heat storage member having a melting point lower than a reference temperature in an air-conditioned office.

Accordingly, as described in the above embodiments, the latent heat storage member 70 can remain in liquid phase in the office environment during work.

As described above, according to the present disclosure, the temperature drop of the target component can be suppressed for a long time.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

What is claimed is:

1. An image forming apparatus comprising:

a target; and a temperature change suppressor opposed adjacent to or disposed in contact with an outer peripheral face of the target, the temperature change suppressor to suppress a temperature change of the target, the temperature change suppressor being a latent heat storage.

2. The image forming apparatus according to claim 1, wherein the temperature change suppressor includes a plurality of temperature change suppressors, and wherein at least one of the plurality of temperature change suppressors is the latent heat storage, and rest of the plurality of temperature change suppressors is a heat insulator.

3. The image forming apparatus according to claim 2, wherein the heat insulator is disposed outboard of the latent heat storage with respect to the target.

4. The image forming apparatus according to claim 1, wherein the temperature change suppressor is disposed extending over an entire area of the target in a longitudinal direction of the target.

5. The image forming apparatus according to claim 1, wherein the temperature change suppressor is disposed below the target in a vertical direction.

6. The image forming apparatus according to claim 1, further comprising a housing, the housing holding an image bearer, a charger, a developer, and a cleaner as a single image forming unit that is removably installed in the image forming apparatus, wherein the temperature change suppressor is installed to the image forming unit.

7. The image forming apparatus according to claim 6, wherein the temperature change suppressor includes a plurality of temperature change suppressors, wherein at least one of the plurality of temperature change suppressors is the latent heat storage, and rest of the plurality of temperature change suppressors is a heat insulator.

8. The image forming apparatus according to claim 1, wherein the temperature change suppressor is removably installed to the image forming apparatus.

9. The image forming apparatus according to claim 8, further comprising a plurality of sheet trays to accommodate a recording medium, wherein the temperature change suppressor is accommodated in at least one of the plurality of sheet trays.

10. The image forming apparatus according to claim 9, wherein the temperature change suppressor is accommodated in a top sheet tray of the plurality of sheet trays.

11. The image forming apparatus according to claim 8, further comprising:

a temperature sensor to detect at least one of an outside temperature, a temperature of the temperature change suppressor, and a temperature of the target; and circuitry configured to determine whether to remove or install the temperature change suppressor based on the at least one of the outside temperature, the temperature of the temperature change suppressor, and the temperature of the target, wherein the temperature change suppressor is a latent heat storage.

12. The image forming apparatus according to claim 11, wherein the circuitry is configured to compare the outside temperature and the temperature of the temperature change suppressor and determine whether to remove or install the temperature change suppressor based on a comparison result of the outside temperature and the temperature of the temperature change suppressor.

13. The image forming apparatus according to claim 1, wherein the temperature change suppressor is a latent heat storage having a melting point of 20° C. or more and 30° C. or less.

14. The image forming apparatus according to claim 1, wherein the temperature change suppressor is a latent heat storage having a melting point lower than a temperature of an environment where the image forming apparatus is used.

15. The image forming apparatus according to claim 1, further comprising:

an image bearer to bear a latent image;

a charger to charge the image bearer;

a developer to develop the latent image on the image bearer; and a cleaner to clean a surface of the image bearer, wherein the target includes at least one of the image bearer, the charger, the developer, and the cleaner.

16. An image forming apparatus comprising:

a target; and a plurality of temperature change suppressors to suppress a temperature change of the target, at least one of the plurality of temperature change suppressors being a latent heat storage, rest of the plurality of temperature change suppressors being a heat insulator.

17. The image forming apparatus according to claim 16, wherein the latent heat storage and the heat insulator are disposed adjacent to the target.

18. An image forming apparatus comprising:

an image forming device to form a toner image on a recording medium;

a waste toner container to store waste toner generated in the image forming device;

a waste toner container mount accommodating the waste toner container; and a temperature change suppressor installed to the waste toner container mount, the temperature change suppressor being a latent heat storage.

* * * * *